US007452175B2

(12) United States Patent
Martin et al.

(10) Patent No.: US 7,452,175 B2
(45) Date of Patent: Nov. 18, 2008

(54) SIDE-LOADING REFUSE COLLECTION APPARATUS AND METHOD

(75) Inventors: Gerald F. Martin, Somerset, PA (US); Todd Mendenhall, Riverton, UT (US); Fred P. Smith, Alpine, UT (US)

(73) Assignee: Collectech Designs, L.L.C., Somerset, PA (US)

( * ) Notice: Subject to any disclaimer, the term of this patent is extended or adjusted under 35 U.S.C. 154(b) by 207 days.

(21) Appl. No.: 10/915,266

(22) Filed: Aug. 10, 2004

(65) Prior Publication Data

US 2005/0063807 A1 Mar. 24, 2005

Related U.S. Application Data

(60) Provisional application No. 60/493,895, filed on Aug. 11, 2003.

(51) Int. Cl.
*B65F 3/20* (2006.01)

(52) U.S. Cl. ..... 414/408; 414/470

(58) Field of Classification Search ..... 414/403, 414/467; 74/105

See application file for complete search history.

(56) References Cited

U.S. PATENT DOCUMENTS

| | | | | |
|---|---|---|---|---|
| 4,597,710 | A | | 7/1986 | Kovats |
| 4,669,940 | A | | 6/1987 | Englehardt et al. |
| 4,872,801 | A | | 10/1989 | Yeazel et al. |
| 5,035,563 | A | | 7/1991 | Mezey |
| 5,044,863 | A | | 9/1991 | LaBass et al. |
| 5,092,731 | A | | 3/1992 | Jones et al. |
| 5,256,027 | A | | 10/1993 | Guest |
| 5,288,196 | A | | 2/1994 | Horning et al. |
| 5,344,273 | A | | 9/1994 | Radlein |
| 5,393,180 | A | | 2/1995 | Van Den Aarsen |
| 5,702,225 | A | | 12/1997 | Ghibaudo |
| 5,795,031 | A | * | 8/1998 | Hagenbuch et al. ..... 298/17.6 |
| 5,813,818 | A | * | 9/1998 | McNeilus et al. ..... 414/407 |
| 5,924,325 | A | * | 7/1999 | Brucher et al. ..... 74/106 |
| 6,000,472 | A | * | 12/1999 | Albright et al. ..... 166/380 |
| 6,146,078 | A | * | 11/2000 | Hamill et al. ..... 414/511 |
| 6,146,079 | A | | 11/2000 | Ghibaudo |
| 6,210,094 | B1 | | 4/2001 | McNeilus et al. |
| 6,250,873 | B1 | | 6/2001 | Stragier |
| 6,390,758 | B1 | * | 5/2002 | McNeilus et al. ..... 414/408 |
| 6,491,489 | B1 | * | 12/2002 | Stragier ..... 414/409 |

(Continued)

OTHER PUBLICATIONS

Athey Waste Control Systems, Specification page for Model CWC-300, date unknown, pp. 1-2.

*Primary Examiner*—Charles A Fox
(74) *Attorney, Agent, or Firm*—Pate Pierce & Baird

(57) ABSTRACT

An apparatus for collecting refuse, the apparatus comprising a vehicle having a frame formed as two substantially parallel members and a hopper secured to the frame. First and second bins may be connected by respective first and second dumping mechanisms to opposite, exterior sides of the hopper. The first and second dumping mechanisms may selectively and independently move respective first and second bins between stowed positions substantially below the hopper and dumping positions above the hopper. The width between the exterior extremes of the first and second bins when both are in stowed positions may substantially be defined by a summation of the width of the first bin, the distance between the outer extremes of the frame, and the width of the second bin.

26 Claims, 18 Drawing Sheets

U.S. PATENT DOCUMENTS 6,494,665 B1 12/2002 Bingman
2002/0098070 A1* 7/2002 Neufeldt ..... 414/525.6
2003/0215315 A1 11/2003 Jones et al.

* cited by examiner

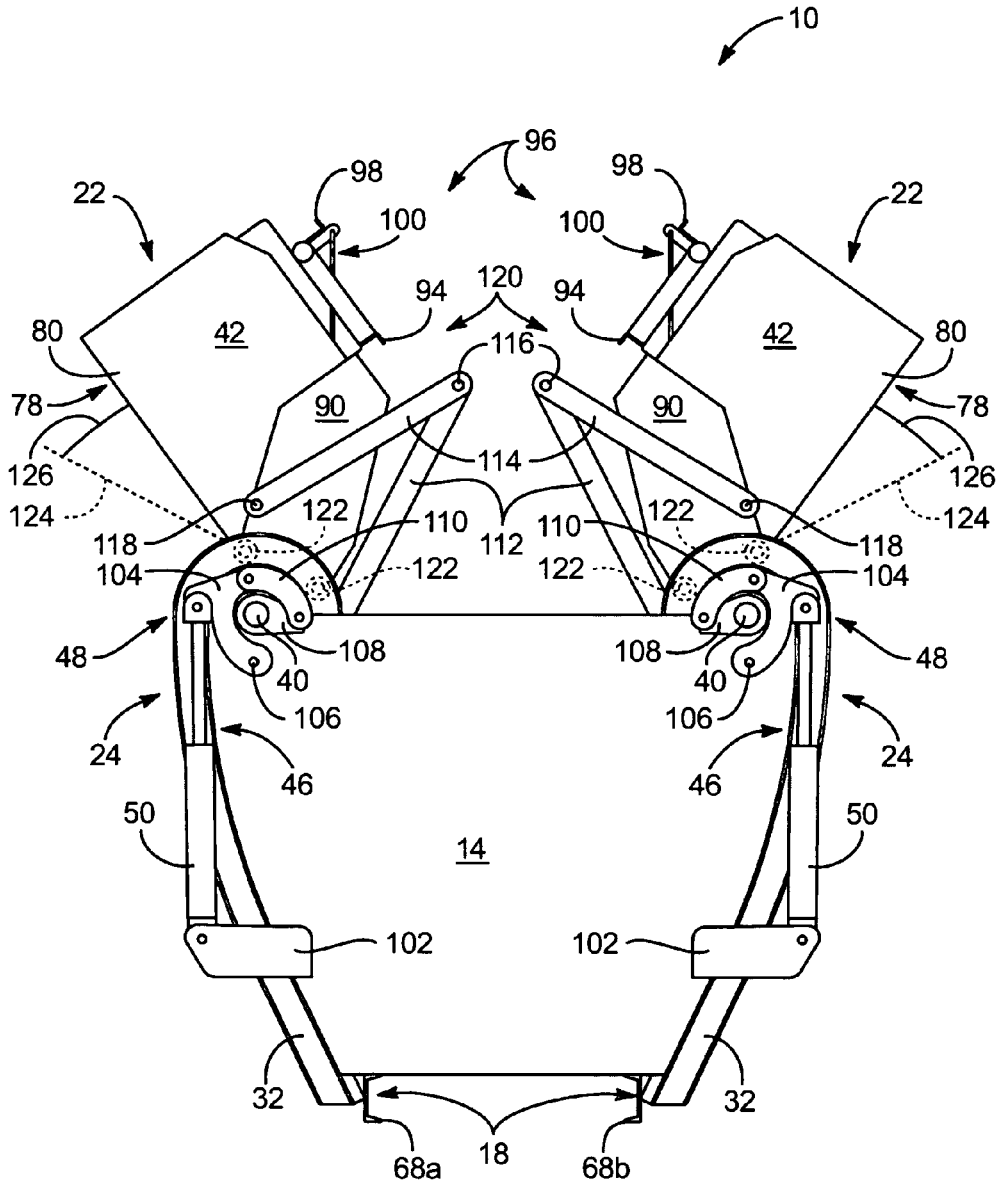
FIG. 6
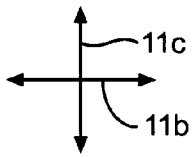

SIDE-LOADING REFUSE COLLECTION APPARATUS AND METHOD

RELATED APPLICATIONS

This application claims the benefit of U.S. Provisional Patent Application Ser. No. 60/493,895, filed on Aug. 11, 2003 for SIDE LOADER COLLECTION AND STORAGE MECHANISM.

BACKGROUND

1. The Field of the Invention

This invention relates to refuse collection vehicles and, more particularly, to novel systems and methods for lifting, dumping, storing, and ejecting refuse.

2. The Background Art

In recent years, the drive toward greater efficiencies has pushed the refuse collection industry toward mechanisms and processes of greater complexity. For example, many municipalities now support the collection of recyclable materials (recycleables) such as metals, plastics, and paper. Increasingly, municipalities are accepting commingled recyclables. This allows a single-compartment collection vehicle to collect recyclable materials. However, non-recyclable refuse must also be collected. Accordingly, different collection vehicles must be used or individual collection vehicles must be arranged to handle recyclable refuse as well as non-recyclable refuse and segregate them.

Another advancement in the collection industry in the use of side loading collection vehicles. Such vehicles increase collection efficiency by reducing the number of crew members and the distance a single manual laborer must travel from the cab to reach the loading area as compared with rear-loading systems. Yet another advancement in the collection industry in the increased use of automated side loaders and standardized collection containers. Automated side loaders are typically equipped with grippers or connecting hardware designed to engage a standardized container of a particular size and shape. After engagement, an automated side loader may lift the standardized container and dump it into a hopper on the collection vehicle. Accordingly, the need for manually dumping the container may be eliminated.

However, many collection routes have a mixture of standardized containers and non-standardized containers. On such routes, it becomes difficult or impractical to dump all of the containers with an automated side loader. Moreover, there may not be a practical method of dumping the non-standardized containers over the high walls of the hopper.

To address these shortcoming, a number of side loaders with buckets or bins for manual loading have been devised. In such designs, a bin may be positioned along the side of a collection vehicle at a height suitable for manual dumping of refuse into it. After receiving refuse manually dumped therein, the bin may be mechanically lifted and dumped into a hopper on the vehicle. Hardware on the outside of the bin may provide a cart tipper allowing standardized containers to be attached to the bin and then dumped into the hopper. Thus, standardized containers may be dumped directly into the hopper while non-standardized containers may be dumped into the bin.

In certain situations, it may be desirable to collect refuse from both sides of a street. Dual bin side loaders (i.e. collection vehicles with an automated bin on each side) are typically, however, too wide to fit within legal limits on vehicle width. Collapsible bins capable of adjusting to fit within the legal limit during transit have proven overly complex.

Current collection vehicles, in general, provide some method or mechanism for removing refuse from the body of the collection vehicle. For example, many collection vehicles use telescopic cylinders to eject the refuse. Telescopic cylinder, however, are problematic. They are costly, difficult to maintain, subject to corrosion and other damage, and often unreliable. Other vehicles use a tilting mechanism to empty the body. However, tilting greatly increases the instability of the collection vehicle during the unloading process, the complexity of unloading stations and procedures, or both. Moreover, when the body is tilted, overhead clearance can also become a problem. This is particularly the case when dealing with recyclable refuse, which is often dumped inside a processing plant.

In view of the foregoing, what is needed is a dual-bin, side-loading, collection vehicle that fits within the legal limit on vehicle width without complicated, collapsible bins. Moreover, what is needed is a dumping system that loads, compacts, and ejects compacted refuse from the body without the use of telescoping hydraulic cylinders or tilting.

BRIEF SUMMARY OF THE INVENTION

Selected embodiments in accordance with the present invention may provide an improved refuse collection vehicle having a frame supporting a cab for housing an operator, a hopper for receiving refuse, and a body for storing refuse. An opening, path, conduit, or the like may be formed between the hopper and body for passing refuse from the hopper to the body. First and second (e.g. right and left) bins may be secured by respective first and second dumping mechanisms to opposite, exterior sides of the hopper. The dumping mechanisms may selectively move respective first and second bins between stowed positions substantially below the hopper and dumping positions above the hopper. The first and second bins may each include engagement mechanisms positioned on an exterior surface thereof to engage and secure a standardized refuse container.

The width in the lateral ( e.g. nominally left and right) direction between the exterior extremes of the first and second bins when both are in stowed positions may be effectively substantially defined by a summation of the width of the first bin in the lateral direction, the distance between the outer extremes of the frame of the collection vehicle (e.g. truck) in the lateral direction, and the width of the second bin in the lateral direction. The bins may be sized so that the resulting width may be within legal limits on vehicle width.

In certain embodiments, the first and second dumping mechanisms may each include a first track secured to the hopper to guide at least one roller extending from a forward end of the respective bin and a second track secured to the hopper to guide at least one roller extending from a rearward end of the respective bin. Additionally, the first and second dumping mechanisms may each include a torsion tube (a rigid member supporting a torsional load), a forward linkage connecting the forward end of the respective bin to the torsion tube, and a rearward linkage connecting the rearward end of the respective bin to the torsion tube.

Tracks in accordance with the present invention may be curved rather than straight. The curvature may allow the bucket to be tilted slightly in the lower section of track prior to reaching the dumping curve or inverter, which inverts the bin over the hopper. This tilt in the lower section of the track may reduce spillage and allow for greater overall dumping angles than straight tracks. Additionally, the curved tracks may also allow for increased hopper volume.

In selected embodiments, the forward and rearward linkages of the present invention may be contained in the space between the exterior sides of the hopper and the legal limit on vehicle width. Accordingly, the top of the hopper may be open and unobstructed to accept dumped material.

The first and second dumping mechanisms may each also include at least one control mechanism selectively controlling rotation of the torsion tube with respect to the hopper. In one embodiment, each control mechanism may comprise a single linear actuator rotationally engaging one end of the corresponding torsion tube.

In certain embodiments, the forward and rearward linkages may be arranged so that nearly equal portions of the stroke or rotation imposed by the control mechanism are used to lift the bin and to rotate (invert about a longitudinal or end-to-end axis) the bin. The resulting motion may provide a natural ramping (acceleration, deceleration, or both) of the speed of the bin. In selected embodiments, the speed may reach a maximum in the lower section of the track and ramp down as the bin is fully raised and inverted. In one embodiment, the natural speed ramping provided by the linkages combined with cushioned actuators may provide a comparatively gentle dumping motion. Accordingly, wear may be reduced and lighter parts used.

In certain embodiments, a refuse collection vehicle in accordance with the present invention may include at least one rail extending from a hopper, through an opening, to the body. An ejector may be positioned within the body and slidingly engaging the rail. A first motive device (e.g. a hydraulic cylinder) may connect the ejector to the vehicle to advance and retract the ejector with respect thereto. The ejector may be primarily responsible for discharging refuse from the body 16 at a landfill, processing plant, or the like. In selected embodiments, more than one motive device may be used to advance and retract the ejector with respect to the vehicle. For example, in one embodiment, two single-stage, double-acting hydraulic cylinders are used to manipulate the position of the ejector with respect to the vehicle.

In operation, a packer may be primarily responsible for passing refuse deposited into the hopper on to the body. The packer may also slidingly engaging the rail. A second motive device may connect the packer to the ejector to advance and retract the packer with respect thereto. In one embodiment, a single-stage, double-acting hydraulic cylinder may be used to advance and retract the packer with respect to the ejector.

In use, an operator may drive the vehicle to a location proximate refuse to be collected. The operator may apply any standardized container to the engagement mechanisms and dump any refuse from non-standardized containers into the bins. The operator may then activate the dumping mechanism corresponding to the loaded bin or bins. The dumping mechanism may lift the bin, and any standardized container optionally secured thereto, over the hopper and dump them. The dumping mechanism may then lower the bin and standardized container. The operator may disengage any standardized container from the bin and drive the vehicle on to the next collection location.

In operation, the ejector may be maintained in a retracted position. In such a position, the motive device connecting the packer to the ejector may move the packer back and forth within the hopper. To receive refuse, the packer may be withdrawn to a retracted position. As the hopper fills, the packer may be advanced to push the refuse through the opening, between the hopper and body, and into the body. To receive additional refuse, the packer may be returned to the retracted position.

As the body fills with refuse, the packer may pack or compress all of the refuse within the body. Once the body is filled to a desired capacity and compaction, the packer may be left in the advanced position. Accordingly, as the tailgate of the vehicle is opened and the ejector advanced, the packer may move with the ejector and assist it in expelling the refuse from the body. Once the refuse is expelled, the ejector and packer may be returned to the their respective retracted positions.

BRIEF DESCRIPTION OF THE DRAWINGS

The features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

FIG. 6 is a front elevation view of the forward end of a hopper with corresponding dumping mechanisms and bins, where the bins are in the dumping position in accordance with the present invention;

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 18, is not intended to limit the scope of the invention, as claimed, but is merely representative of various exemplary embodiments of the invention. The illustrated embodiments of the invention will be best understood by reference to the drawings, wherein like parts are designated by like numerals throughout.

Figure 1:
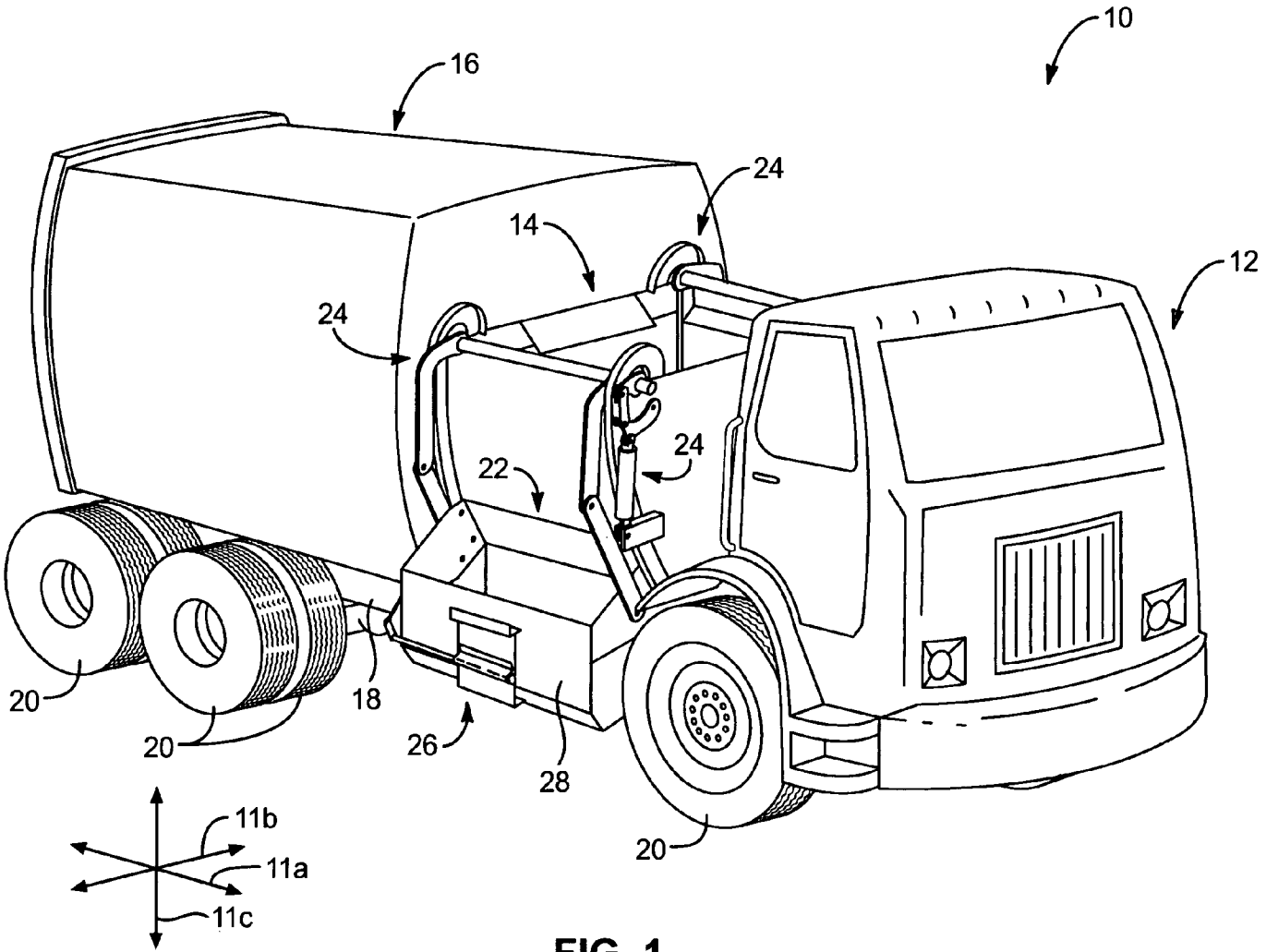
FIG. 1 is a perspective view of a vehicle for collection, storage, and transportation of refuse in accordance with the present invention.

Referring to FIG. 1, a vehicle 10 for collecting and storing refuse may define a coordinate axis comprising longitudinal 11*a*, lateral 11*b*, and transverse 11*c*, directions substantially orthogonal to one another. The vehicle 10 may include a cab 12 for an operator, a hopper 14 for receiving refuse, and a body 16 for storing the refuse until it can be dumped at a suitable location. The cab 12, hopper 14, and body 16 may all secure to a frame 18. Wheels 20 may support the frame 18 above the ground or other supporting surface. The number of wheels 20 may be selected to accommodate an expected loading of the vehicle 10. Generally, the greater the expected loading, the greater the number of wheels 20 required to distribute the load across the ground or road surface.

Vehicles 10 in accordance with the present invention may come in various sizes. In general, there may be a desire to maximize the size of the vehicle 10, particularly the size of the body 16. Larger bodies 16 allow an operator to collect greater quantities of refuse before returning to a dumping site (e.g. landfill, processing plant). Because the dumping site may be some distance from the area where the refuse is collected, lowering the number of dumping runs may significantly improve collection efficiency.

On the other hand, there may be factors arguing for smaller vehicles 10. For example, collection areas are often residential. Smaller vehicles 10 may more easily maneuver through narrow streets, around parked cars, obstacles, and the like often found in residential neighborhoods. Smaller vehicles 10 may also be less expensive to build and, consequently, to purchase. Accordingly, municipalities, as well as private collection companies, may prefer a larger fleet of comparatively small vehicles 10 over a smaller fleet of comparatively large vehicles 10.

In any case, while selecting the size of a vehicle 10 for refuse collection certainly may involve balancing many factors, requirements, and the like, the present invention may be applied to vehicles 10 of all sizes. The concepts of the present invention may be scaled up or down as necessary.

Similarly, a vehicle 10 in accordance with the present invention may be arranged to receive any suitable refuse. Suitable refuse may include recyclable refuse as well as non-recyclable refuse. If desired, a vehicle 10 in accordance with the present invention may be arranged to receive only one type of refuse (e.g. recyclable refuse, non-recyclable refuse) in a specific collection run. Alternatively, a vehicle 10 in accordance with the present invention may be divided to simultaneously receive multiple types of refuse. For example, recyclable refuse may be dumped by a left side bin into a left side of a divided hopper 14, while non-recyclable refuse may be dumped by a right side bin into a right side of the divided hopper 14. The body 16 may be similarly divided. Even end-to-end segregation by bins and hoppers is within contemplation.

A vehicle 10 in accordance with the present invention may include one or more bins 22 for receiving refuse. One or more dumping mechanisms 24 may each connect a bin 22 to the vehicle 10. In selected embodiments, a dumping mechanism 24 may connect a bin 22 to the hopper 14. An engagement mechanism 26 may be positioned on an exterior face 28 of a bin 22. The engagement mechanism 26 may facilitate securement of a standardized container to the bin 22.

In use, an operator may drive the vehicle 10 to a location proximate refuse to be collected. The operator may apply any standardized container to the engagement mechanism 26 and dump any refuse from non-standardized containers into the bin 22. The operator may then activate the dumping mechanism 24 corresponding to the loaded bin 22. The dumping mechanism 24 may lift the bin 22, and any standardized container secured thereto, over the hopper 14 and dump them. The dumping mechanism 24 may then lower the bin 22. The operator may disengage any standardized container from the bin 22 and drive the vehicle 10 on to the next collection location. Bins 22 and standardized containers may be approached on either side of the vehicle 10. Thus a zig zag pattern is available on sparsely populated roads.

Any suitable number of operators may assist in the activities of a vehicle 10 in accordance with the present invention. For example, in certain situations, three operators may be involved. The first operator may drive the vehicle 10, the second operator may load refuse into a bin 22 on the right side of the vehicle 10, and the third operator may load refuse into a bin 22 on the left side of the vehicle 10.

Figure 2:
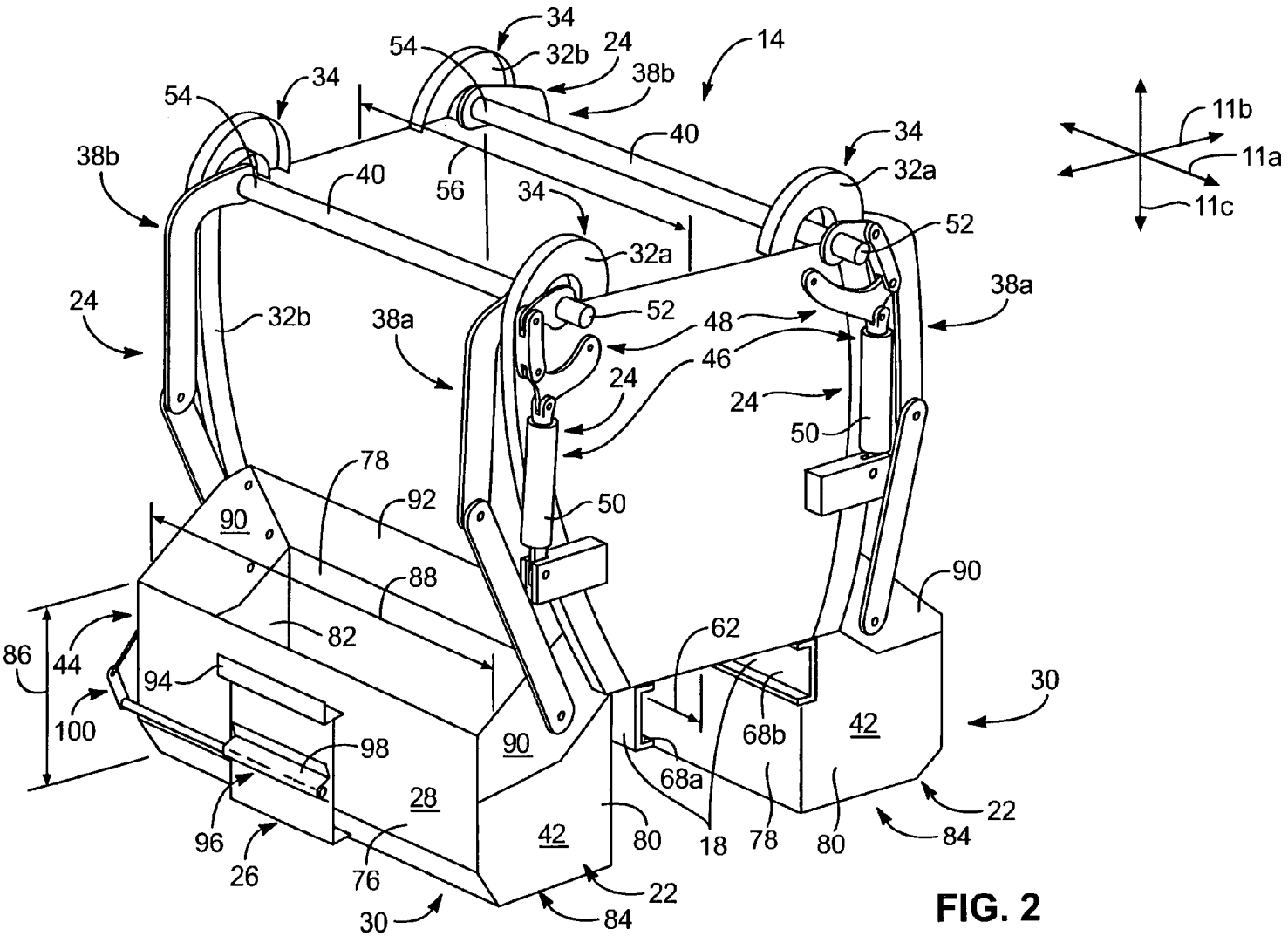
FIG. 2 is a perspective view of a right and left bin secured by respective right and left dumping mechanisms to a hopper.
Figure 3:
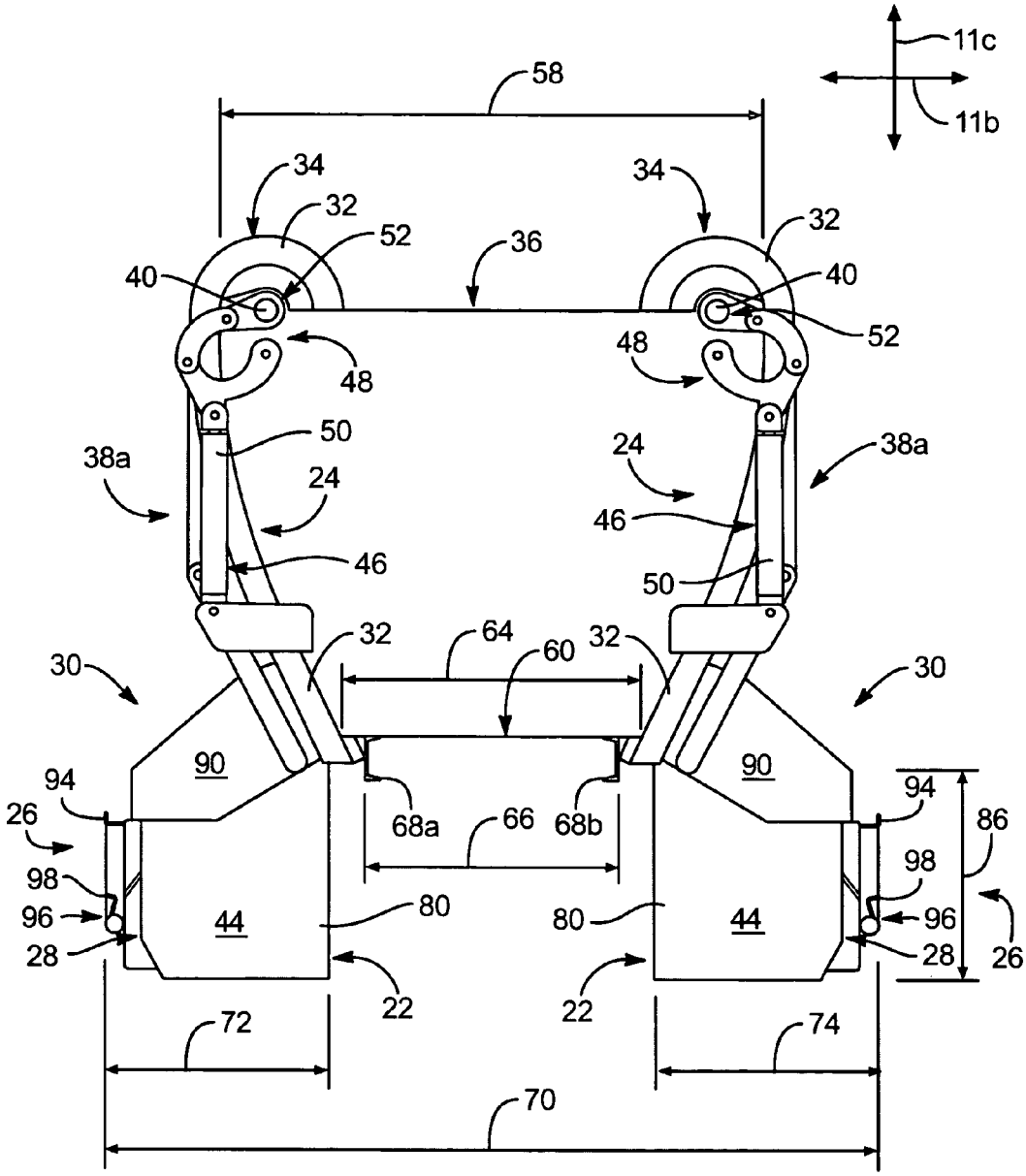
FIG. 3 is a front elevation view of the forward end of the hopper, bins, and dumping mechanisms of FIG. 2.
Figure 4:
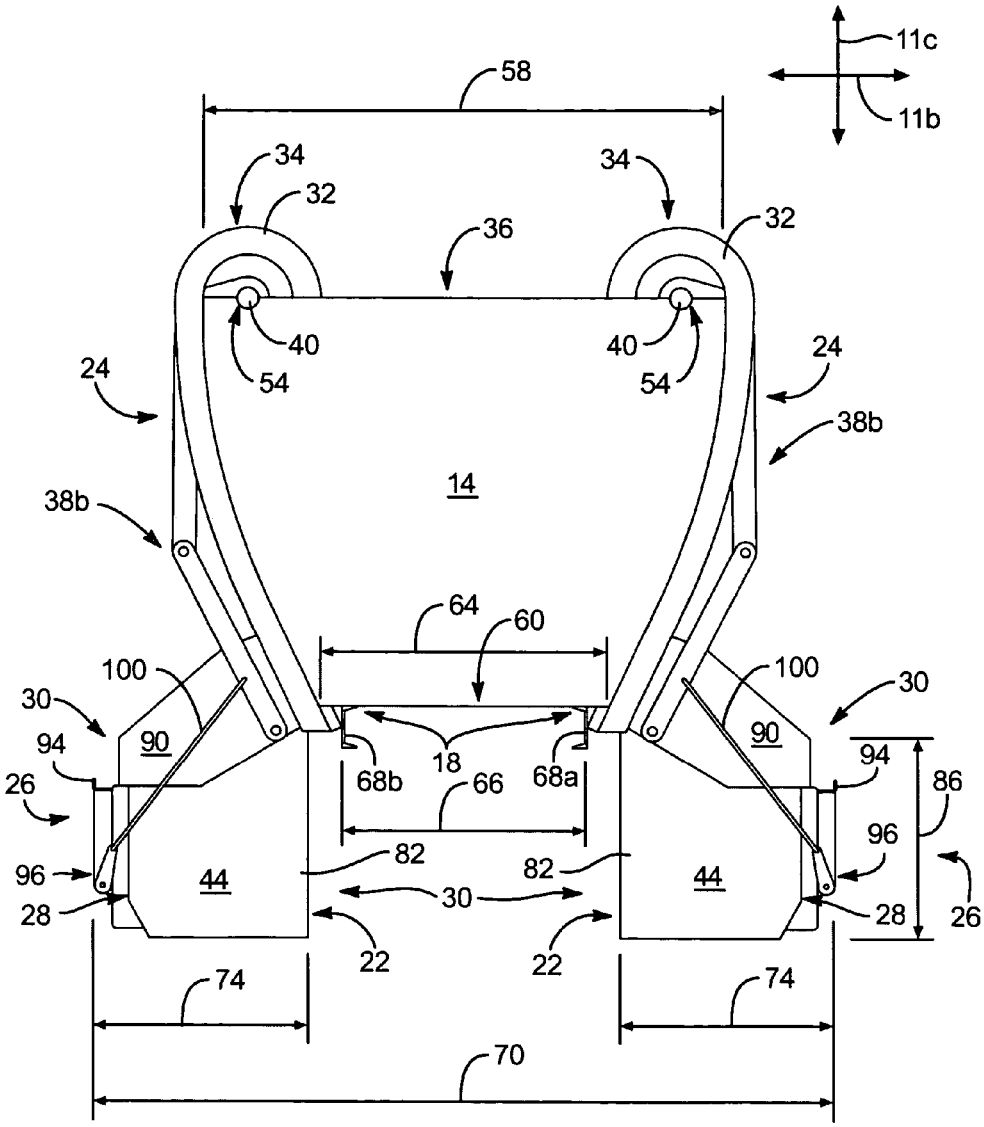
FIG. 4 is a rear elevation view of the rearward end of the hopper, bins, and dumping mechanisms of FIG. 2.

Referring to FIGS. 2-4, dumping mechanisms 24 in accordance with the present invention may include any mechanism capable of lifting a bin 22 from a stowed position 30 where a substantial portion of the bin 22 is below the hopper 14 in the transverse direction 11*c* to a dumping position where a substantial portion of the bin 22 is above the hopper 14 in the transverse direction 11*c*. In certain embodiments, a dumping mechanism 24 may include one or more tracks 32 to guide a bin 22 as it travels from the stowed position 30 to the dumping position above (e.g. dumping position 120 shown in FIG. 6). Tracks 32 in accordance with the present invention may extend from proximate the frame 18, upward along the contours of the hopper 14, to form an inverter 34 at an open top 36 of the hopper 14.

In one embodiment, an inverter 34 may be a portion of a track 32 that is curved through some angle (e.g. one hundred eighty degrees). Accordingly, as a bin 22 travels through the inverter 34, the bin 22 transitions from an upright position to a generally inverted, dumping position that permits refuse to fall from the bin 22 into the hopper 14.

In selected embodiments, a dumping mechanism 24 may propel a bin 22 along one or more tracks 32 through the use of one or more linkages 38 connected to a torsion tube 40. For example, in one embodiment, a bin 22 in accordance with the present invention may travel on rollers extending from a forward end 42 thereof to engage a forward track 32*a* and rollers extending from a rearward end 44 thereof to engage a rearward track 32*b*. A forward linkage 38*a* may connect the forward end 42 of the bin 22 to the torsion tube 40 while a rearward linkage 38*b* may connect the rearward end 44 of the bin to the torsion tube 40. The forward and rearward linkages 38*a*, 38*b* may be arranged such that rotation of the torsion tube 40 induces movement of the bin 22 along the tracks 32*a*, 32*b*.

A dumping mechanism 24 in accordance with the present invention may include a control mechanism 46 to control the rotational positioning of the torsion tube 40. In one embodiment, a control mechanism 46 may comprise a linkage 48 pivoting under the impetus of a single-stage, double-acting hydraulic cylinder 50. A control mechanism 46 may be positioned at any suitable location along the torsion tube 40. Suitable positions may include either end 52, 54 of the torsion tube 40 or some position therebetween.

If desired, more than one control mechanism 46 may be applied to a single torsion tube 40. For example, a first control mechanism 46 may be applied to a forward end 52 of the torsion tube 40 while a second control mechanism 46 may be applied to a rearward end 54 of the torsion tube 40. In such an embodiment, the first control mechanism 46 may be primarily responsible for the loads lifted by the forward linkage 38*a*. The second control mechanism 46 may be primarily responsible for the loads lifted by the rearward linkage 38*b*. If desired, the torsion tube 40 may act as a synchronizer to stop one control mechanism 46 or linkage 38 from getting ahead of the other.

A torsion tube 40 in accordance with the present invention may be secured to the hopper 14 in any suitable manner. In selected embodiments, a bushing, bearing, or the like may be employed at the interface between the torsion tube 40 and the hopper 14 to permit rotation of the torsion tube 40 with respect to the hopper 14 about an axis extending in the longitudinal direction 11*a*.

A torsion tube 40 may have any suitable cross-section. Suitable cross-sections may be circular, rectangular, triangular, hollow, solid, and the like. The shape and size of a torsion tube 40 may be selected to provide a desired torsional stiffness and strength. The desired torsional stiffness and strength may vary from embodiment to embodiment. For example, an embodiment having a torsion tube 40 controlled by one control mechanism 46 positioned at one end thereof may require a more torsionally rigid tube 40 than an embodiment utilizing two control mechanisms 46. The torsional strength of a torsion tube 40 may be increased by selecting a stronger material, increasing the effective diameter, increasing the effective wall thickness, or some combination thereof.

A hopper 14 in accordance with the present invention may have any suitable shape. General considerations that may be taken into account when sizing and shaping a hopper 14 may include providing an open top 36 of sufficient length 56 and width 58 for easy filling and feeding. A hopper 14 may have an open top 36 having a length 56 sufficient to receive all the refuse dumped by a reasonably sized bin 22. A hopper 14 that is too short may require the use of a bin 22 that is too short to receive a practical amount of refuse (e.g. an amount or type of refuse that may be collected at a typical residence). Conversely, a hopper 14 that is too long may occupy space that may be more effectively utilized by the body 16 to store compacted refuse.

The width 58 of the open top 36 of a hopper 14 may be selected to provide an unobstructed path for refuse exiting a dumping bin 22 to enter into the hopper 14. In selected embodiments, the width 58 of the open top 36 of a hopper 14 may be selected to provide an unobstructed path for refuse exiting both a right side and a left side bin 22. In one embodiment, a hopper 14 may have an open top 36 with a width 58 selected to permit simultaneous dumping of the right side and left side bins 22.

The dimensions of the closed bottom 60 of a hopper 14 may differ from those of the open top 36. For example, in selected embodiments, the length 62 of the closed bottom 60 may be substantially equal to the length 56 of the open top 36, while the width 64 of the closed bottom 60 may be significantly less than the width 58 of the open top 36. In one embodiment, a hopper 14 may taper from a wide, open top 36 to a closed bottom 60 having a width 64 substantially equal to the distance 66 between two parallel frame members 68*a*, 68*b*.

In selected embodiments, parallel frame members 68*a*, 68*b* may form the frame 18 of the vehicle 10. Alternatively, frame members 68*a*, 68*b* may secure to the frame 18 of the vehicle 10. In the latter, the distance 66 between the frame members 68*a*, 68*b* may match the width of the longitudinally 11*a* extending frame 18 of the vehicle 10. In any case, the tracks 32 guiding the bins 22 may follow the taper of the hopper 14. Accordingly, in such embodiments, bins 22 in the stowed position 30 may be positioned substantially adjacent the frame 18.

By limiting the width 64 of the closed bottom 60, the total width 70 in the lateral direction 11*b* of a dual bin 22 vehicle 10 in accordance with the present invention may be maintained within legal limits without imposing undue limitations of the size or configuration of the bins 22. The total width 70 may be defined as the distance between the exterior extremes of the right side and left side bins 22 when both are in stowed positions 30. In selected embodiments, the total width 70, may substantially be a summation of the width 72 of a right side bin 22 in the lateral direction 11*b*, the distance 66 between the outer extremes of the frame 18 in the lateral direction 11*b*, and the width 74 of a left side bin 22 in the lateral direction 11*b*.

The current, generally accepted legal limit on vehicle width is one hundred two inches. Given that the distance 66 between outer extremes of the frame 18 is typically about thirty-four inches, in selected embodiments, each bin 22 may have a width 72, 74 of about twenty-four inches to about thirty-four inches. However, such dimensions 72, 74 may vary outside of this range to accommodate changes in the generally accepted legal limit on vehicle width or typical distance 66 between outer extremes of the frame 18. Additionally, particular embodiments within the scope of the present invention may be generated specifically to meet non-conventional legal limits on vehicle width imposed within any particular jurisdiction.

A bin 22 in accordance with the present invention may have any suitable shape. In one embodiment, a bin 22 may be generally rectangular in shape. For example, a bin 22 may include generally planar exterior 76, interior 78, forward 80, rearward 82, and bottom 84 panels. The top of such a bin 22 may be left open and unobstructed to facilitate acceptance and discharge of refuse.

Bins 22 in accordance with the present invention may have any suitable size (e.g. internal volume). The size of a bin 22 may be selected to meet desired operating requirements. For example, in situations where it is desired to empty a bin 22 as few times as possible, a larger bin 22 may be advantageous. In other situations where a bin 22 may be quickly dumped anytime that it is filled to capacity, the size or internal volume of the bin 22 may be less important.

The size or internal volume of a bin 22 may be controlled by adjusting the depth 86, width 72, 74, or length 88 thereof. In general, a bin 22 may be sized to receive the typically received amount of refuse collected at a single collection site. In such an arrangement, the bin 22 does not usurp space on the vehicle 10 that may be more effectively used by the body 16. Additionally, a bin 22 so sized may typically be operated (i.e. lifted and dumped) once per stop of the vehicle 10. Operating a bin 22 more than once per stop may induce inefficiencies that shift the balance of considerations toward a larger bin 22.

A bin 22 may have any structures necessary to facilitate securement of the bin 22 to the corresponding dumping mechanism 24. For example, in one embodiment, a bin 22 may have extensions 90 extending from the forward and rearward panels 80, 82. Each extension 90 may have one or more rollers extending therefrom to engage and travel within the corresponding track 32. In one embodiment, extensions 90 in accordance with the present invention may be generally planar and act in conjunction with a cross member 92 positioned above an interior panel 78 to increase the effective refuse carrying capacity of the bin 22.

An engagement mechanism 26 (e.g. a cart tipper 26) may facilitate securement of a standardized refuse container to the bin 22 during the dumping process. Various standardized refuse containers are currently in use. An engagement mechanism 26 in accordance with the present invention may be selected or configured to secure any such container. For example, an engagement mechanism 26 may employ gripper arms that encircle a container positioned proximate thereto.

Alternatively, an engagement mechanism 26 may include a primary hook 94 extending to engage a corresponding lip on a refuse container. An operator may position a refuse container proximate the hook such that as a bin 22 is lifted by a dumping mechanism 24, the primary hook 94 engages and lifts the container. An engagement mechanism 26 may also include a lock 96 to maintain the container in engagement with the primary hook 94 as the container is inverted over the hopper 14.

In selected embodiments, a lock 96 may include a secondary hook 98. The second hook 98 may pivot into engagement with the container as the container is lifted up the side of the hopper 14. In one embodiment, the secondary hook 98 may be connected by a locking linkage 100 to one of the linkages 38 responsible for lifting the bin 22. In such an arrangement, movement of the linkage 38 as it manipulates a bin 22 may be transmitted through the locking linkage 100 to the secondary hook 98 to induce engagement and disengagement thereof. If desired, the locking linkage 100 may be arranged to induce engagement of the secondary hook 98 with the container as the bin 22 is lifted and disengagement of the secondary hook 98 from the container as the bin 22 is lowered.

Figure 5:
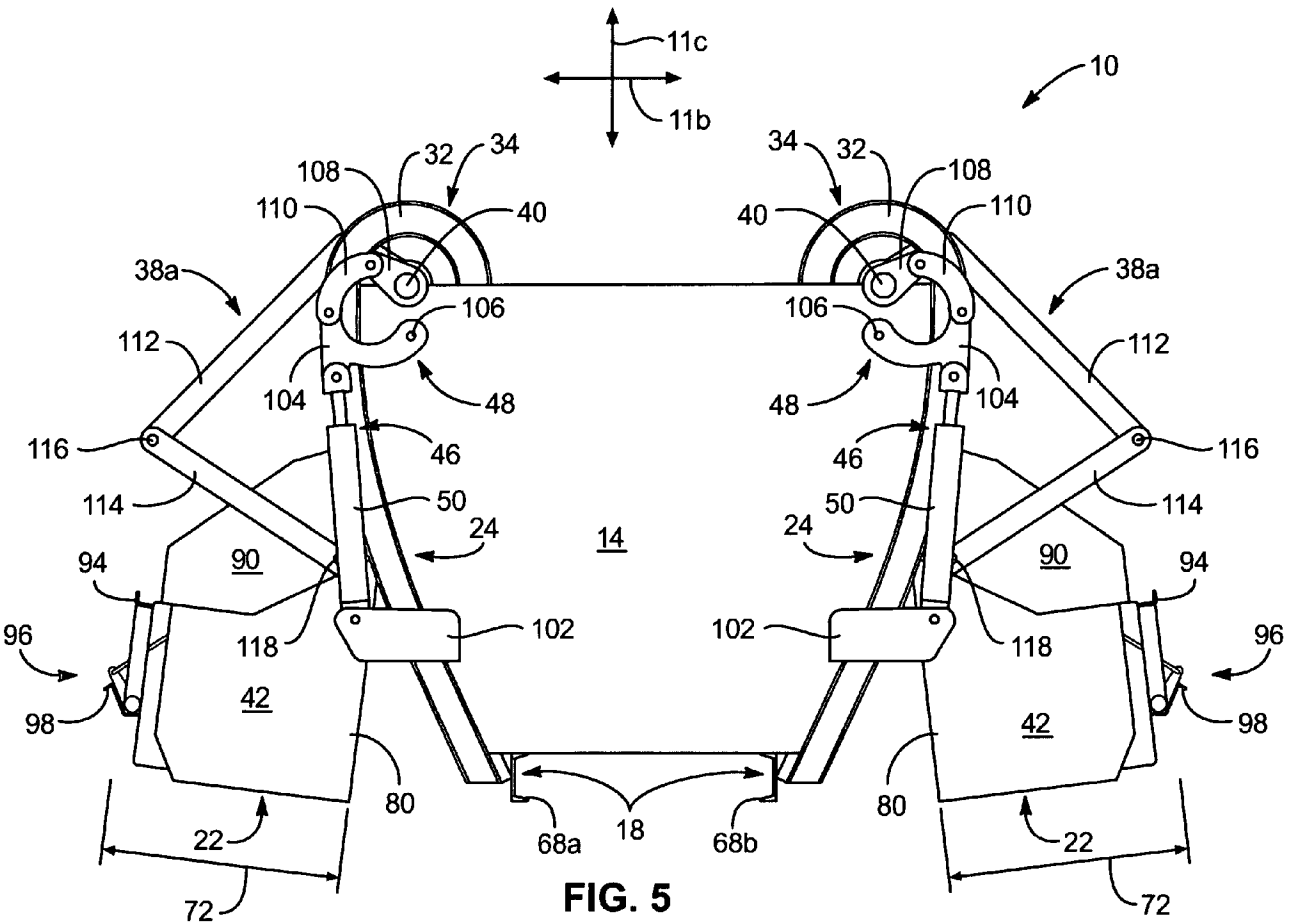
FIG. 5 is a front elevation view of the forward end of a hopper with corresponding dumping mechanisms and bins, where the bins are in transition between the stowed position and the dumping position in accordance with the present invention.

Referring to FIG. 5, upon activation of the control mechanism 46, a hydraulic cylinder 50 may extend between an extension 102 and a C-link 104. For example, in one embodiment, an extension 102 may be rigidly connected to the hopper 14. The C-link 104 may be connected to the hopper 14 by a pivot 106. Accordingly, as the hydraulic cylinder 50 expands, it may push off of the extension 102 to rotate the C-link 104 about the pivot 106.

A control mechanism 46 may also include a control arm 108 fixed with respect to the torsion tube 40 to extend therefrom. An intermediate link 110 may pivotably connect the control arm 108 to the C-link 104. In such embodiments, as the C-link 104 is pivoted by the hydraulic cylinder 50, it may impart motion to the intermediate link 110, which in turn may impart motion to the control arm 108. In that the control arm 108 is fixed with respect to the torsion tube 40, motion of the control arm 108 may result in rotation of the torsion tube 40.

A control linkage 46 in accordance with the present invention may be arranged to provide a desired, maximum angle of rotation of the torsion tube 40. For example, a control linkage 46 comprising a C-link 104 acting in conjunction with an intermediate link 110 may allow a single hydraulic cylinder 50 to induce a rotation of greater than one hundred eighty degrees in a torsion tube 40. If less than one hundred eight degrees of rotation of the torsion tube 40 is required to sufficiently dump a bin 22, a simpler control linkage 46 may be employed. For example, in one embodiment, a hydraulic cylinder 50 may extend directly from an extension 102 to the control arm 108.

Rotation of the torsion tube 40 may cause the lifting linkages 38 extending between the torsion tube 40 and the bin 22 to lift the bin 22. For example, in one embodiment, a lifting linkage 38 may include a lifting arm 112 fixed with respect to the torsion tube 40 to extend therefrom. An intermediate link 114 may connect the lifting link 112 to the bin 22. A first pivot 116 may connect one end of the lifting arm 112 to the intermediate linkage 114. A second pivot 118 may connect the other end of the lifting arm 112 to the bin 22.

Referring to FIG. 6, a control mechanism 46 may induce rotation of a torsion tube 40 until a bin 22 has been lifted by one or more lifting linkages 38 to a dumping position 120. In the dumping position 120, refuse contained within the bin 22 may fall through the open top 36 into the hopper 14.

In selected embodiments, one or more rollers 122 may extend from a bin 22 to engage a track 32. In one embodiment, two rollers 122 may extend from each end 42, 44 of a bin 22. If desired, the two rollers 122 may be secured to a bin along a line 124 positioned at an angle 126 with respect to the bin 22. For example, the line 124 along which the rollers 122 are located may be positioned at an acute angle 126 with respect to an interior panel 78 of the bin 22.

Angling rollers 122 with respect to a bin 22 in accordance with the present invention may provide selected advantages. For example, angling the rollers 122 may allow a bin 22 to hang vertically when the track 32 supporting the bin 22 is angled. This may be useful in situations where a track 32 follows the contours of a hopper 14 having an open top 36 with a width 58 significantly greater that the width 64 of the closed bottom 60 near the frame 18. Additionally, angling rollers 122 may increase the inversion of the bin 22 by the magnitude of the angle 126.

Figure 7:
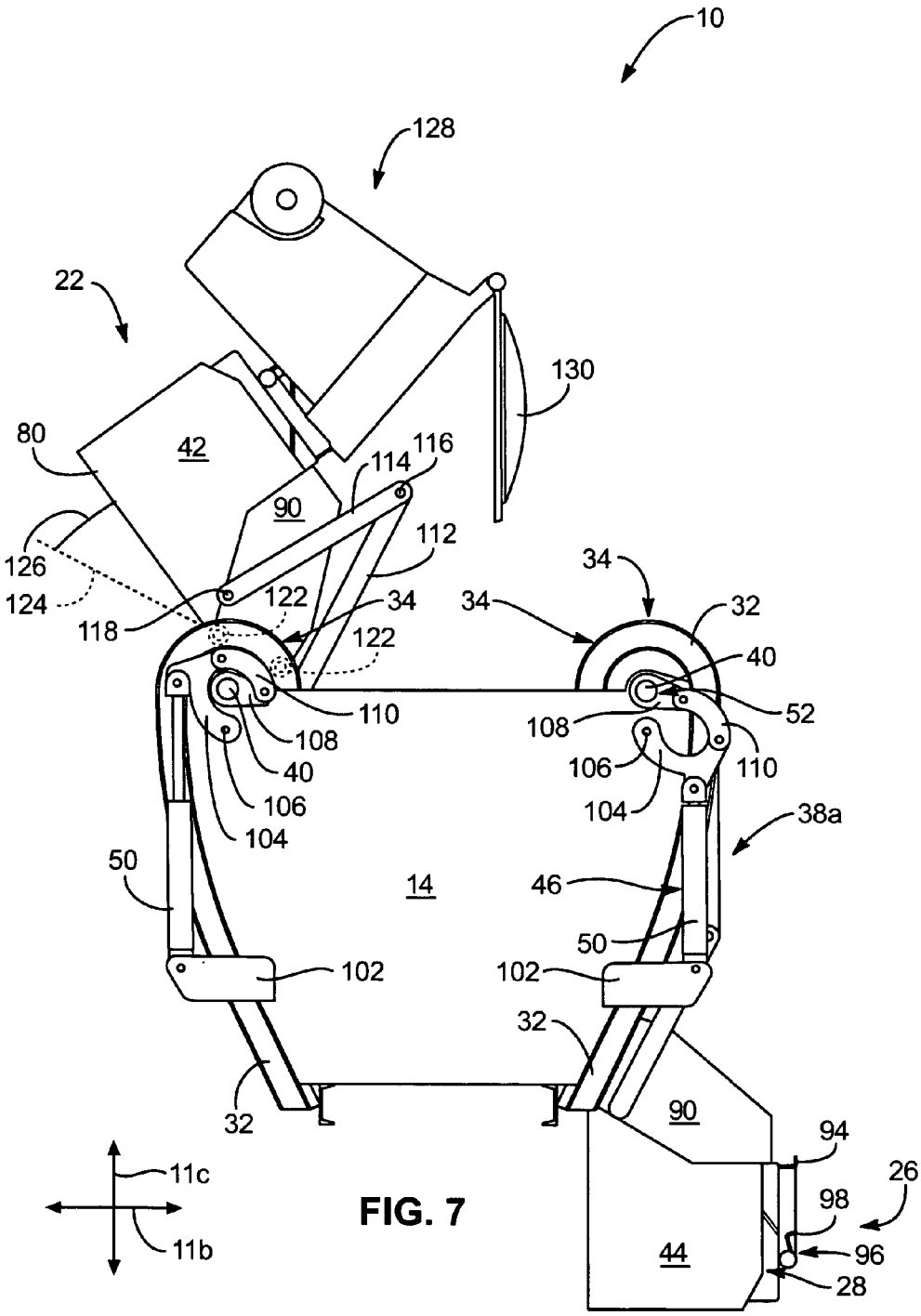
FIG. 7 is a front elevation view of the forward end of a hopper with corresponding dumping mechanisms and bins, where one bin is in the stowed position and the other is securing a standardized refuse container in the dumping position in accordance with the present invention.

Referring to FIG. 7, in situations where the engagement mechanism 26 secures a standardized container 128, refuse within the standardized container 128 may be dumped into the hopper 14 simultaneously with the refuse within the bin 22.

In selected embodiments, a standardized container 128 with a bin 22 may occupy significantly more space above the hopper 14 than a bin 22 alone. Additionally, a standardized container 128 may have a lid 130 that further consumes available space. As a result, in selected embodiments, only one bin 22 lifting a standardized container 128 may be dumped at a time.

In alternative embodiments, adjustments may be made to permit simultaneous dumping of both right and left bins 22 when both are lifting standardized containers 128. For example, standardized containers 28 may be formed without lids 130 or with lids 130 that hinge in a direction that would not interfere with the dumping of an opposing standardized container 128. In selected embodiments, the lids 130 may be altered and the widths 72, 74 of the bins 22 may be decreased to provide additional space. Containers 28 may also be located with respect to bins 22 to facilitate simultaneous dumping.

In another alternative embodiment, the locations of the engagement mechanisms 26 on the right and left bins 22 may be staggered. Generally, a bin 22 in accordance with the present invention has a length 88 significantly greater than the standardized container 128. Accordingly, the engagement mechanism 26 on a right bin 22 may be positioned on the exterior face 28 proximate the forward end 42 of the bin 22. The engagement mechanism 26 on a left bin 22 may be positioned on the exterior face 28 proximate the rearward end 42 of the bin 22. In such an arrangement, the bins 22 may be sufficiently long to permit simultaneous dumping of a forward positioned container 128 and the rearward positioned container 128 without mutual interference.

In certain embodiments, multiple engagement mechanisms 26 may be positioned on the exterior face 28 of a single bin 22. For example, a bin 22 may support a forwardly positioned engagement mechanism 26 and a rearwardly positioned engagement mechanism 26. In such an arrangement, a single bin 22 may simultaneously lift and dump two standardized containers 128. If desired, the locking linkage 100 may provide the rotation necessary to deploy both secondary hooks 98 to maintain engagement when both containers 128 are inverted.

Figure 8:
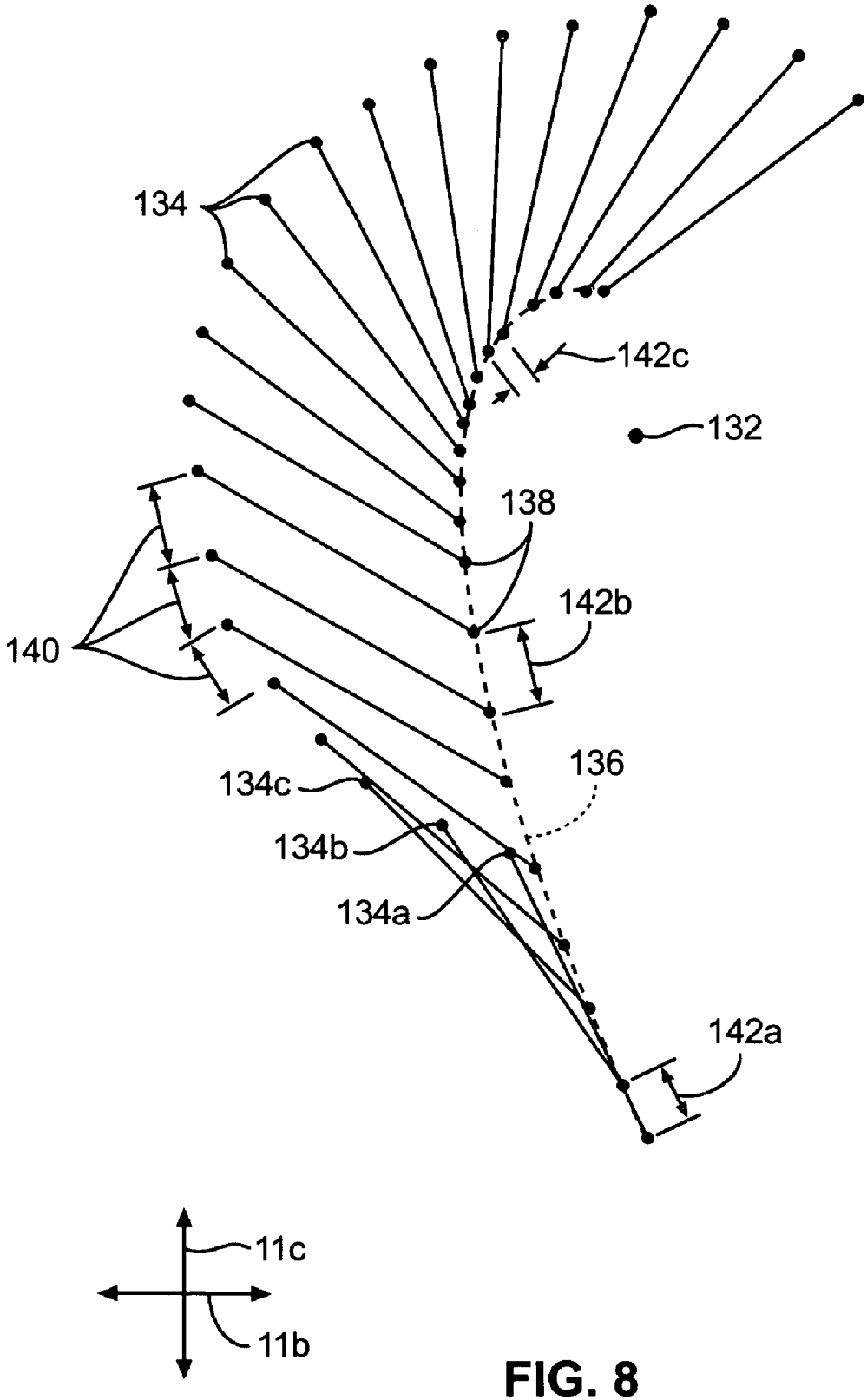
FIG. 8 is a plot illustrating the incremental motion of a linkage lifting a bin along a track in accordance with the present invention.

Referring to FIG. 8, in selected embodiments, a lifting linkage 38 in accordance with the present invention may be arranged to provide a desired acceleration profile in lifting, dumping, and lowering a bin 22. In general, machinery wears better when accelerations are minimized. Additionally, decreasing the accelerations demanded permits the machinery to be built from lighter, generally less expensive parts. In selected embodiments, the contour of the tracks 32, the length and positioning of the lifting arms 112, and the length and positioning of the intermediate links 114 may be selected to provide the desired acceleration profile or ramping.

For example, accelerations may be controlled by forming an inverter 34 in the track 32 that follows the circumference of a half-circle with its center located at the axis 132 about which the torsion tube 40 rotates. Under such an arrangement, once the rollers 122 reach the inverter 34, the bin 22 and lifting arm 112 are essential rotating about the torsion tube 44 at the same rate. Accordingly, accelerations as the bin 22 passes around an inverter 34 may be substantially limited to centrifugal acceleration.

In certain embodiments, when a bin 22 is in the stowed position 30, a lifting arm 112 may extend substantially downward to meet an intermediate link 114, which is extending substantially upward. When the torsion tube 40 is rotated, such an arrangement may limit the initial acceleration of the bin 22 along the track 32.

For example, suppose that a torsion tube 40 were rotated at a constant angular velocity. As rotation of the torsion tube 40 begins, a lifting arm 112 may extend downward therefrom. Accordingly, the position 134*a* of the first pivot 116 at initiation is substantially below the axis 132 about which the torsion tube 40 rotates. After a particular time interval, the first pivot 116 occupies a new position 134*b*. After another time interval of the same magnitude, the first pivot 116 occupies another position 134*c*, and so forth. The various positions 134 of the first pivot 116 are located on the circumference of a circle centered at the axis 132 of the torsion tube 40.

Because the second pivot 118 travels with the bin 22, the second pivot 118 follows a path 136 determined by the track 32. At initiation, when the bin 22 is in the stowed position 30, the position 138*a* of the second pivot 118 is substantially below the axis 132 of the torsion tube 40. As the lifting arm 112 rotates, the second pivot 118 follows the path 136 determined by the track 32. Accordingly, the position 138 of the second pivot 118, and consequently the bin 22, may be determined for each position 134 of the first pivot 112.

As can be seen in FIG. 8, the distance 140 between the various positions of the first pivot 116 are substantially equal, indicating that the lifting arm 112 is moving at a substantially constant rate. In contrast, the distance 142 between the various positions 138 of the second pivot 118 are not substantially equal, indicating that the velocity of the bin 22 changes as it travels along the path 136 determined by the track 32.

For example, near initiation, the distance traveled 142*a* in the particular time interval is much less that the distance traveled 142*b* in the middle part of the track 32. Moreover, when the second pivot 118 nears the inverter 34, the distance traveled 142*c* in the particular time period greatly decreases. Thus, in the illustrated embodiment, the bin 22 starts at one velocity, gradually accelerates to a maximum velocity in the middle of the track 32, then gradually slows to round the inverter 34. When being lowered, a bin 22 so arranged may follow the same acceleration profile but in opposite order.

In selected embodiments, a control mechanism 46 may not rotate a torsion tube 40 at a uniform rate. For example, a control linkage 48 may cause cyclical accelerations such as those often encountered when translating devices of constant speed are used to induce rotation (e.g. such as though a crank). However, the end acceleration experienced by a bin 22 being lifted along a track 32 is a superposition of all the relevant accelerations. Accordingly, in certain embodiments, the gradual accelerations through large changes in velocity that are generated by a lifting arm 112, intermediate link 114, and the track 32 in accordance with the present invention may be sufficient to shine through or overpower any undesirable accelerations superimposed therewith to produce a desirable end result.

Figure 9:
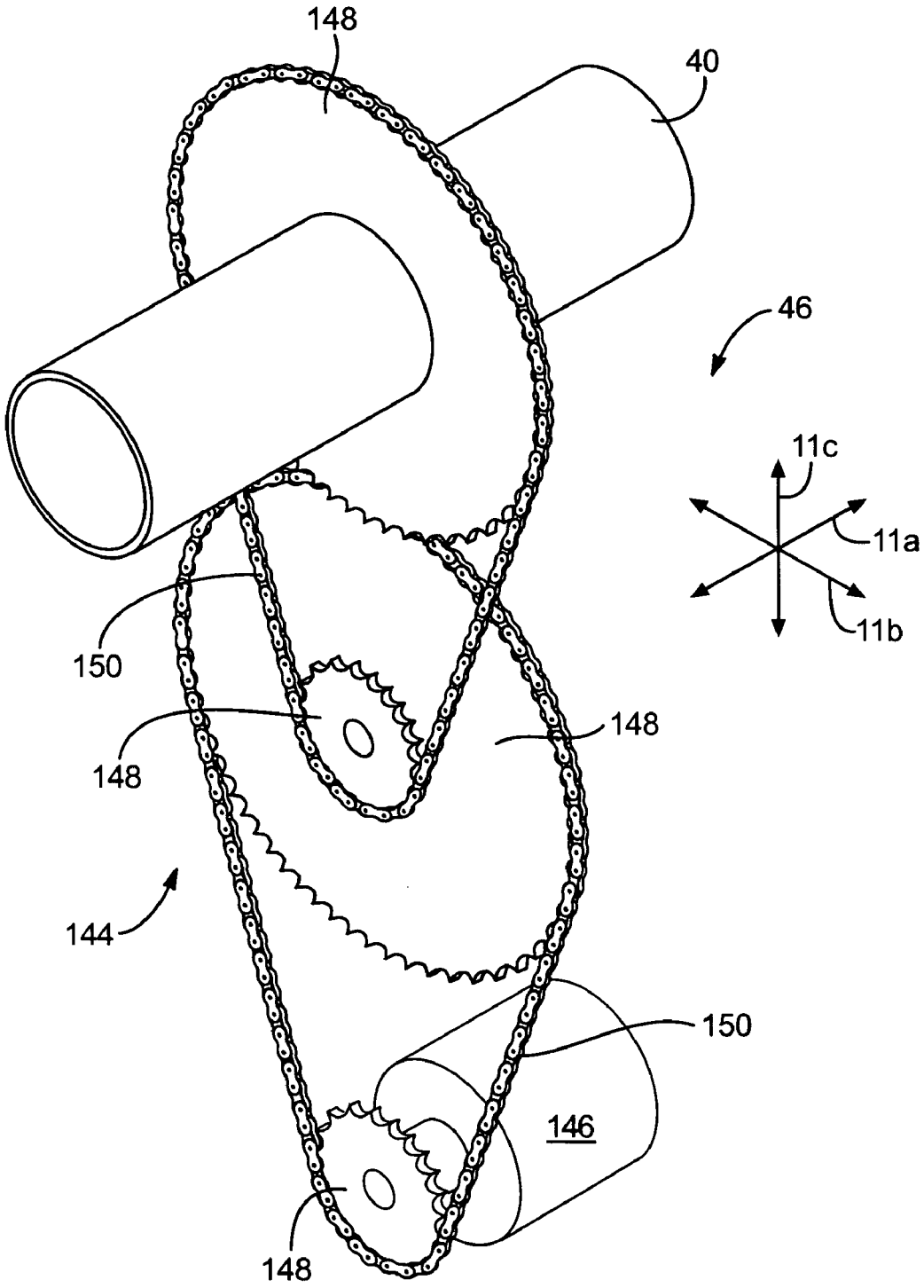
FIG. 9 is a perspective view of an alternative embodiment of a control mechanism for inducing rotation of a torsion tube in accordance with the present invention.
Figure 10:
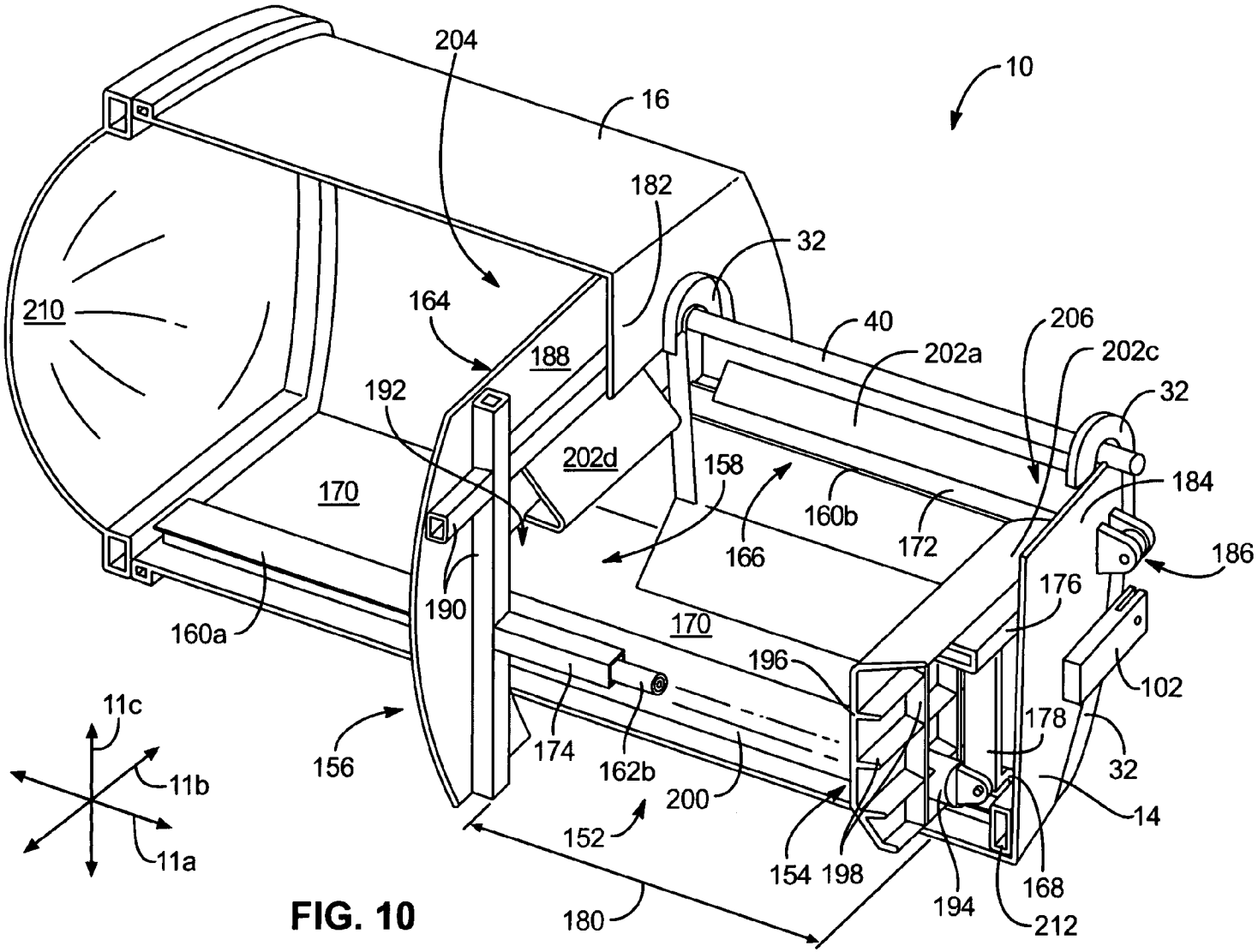
FIG. 10 is a partially cut-away, perspective view of a hopper and body with both the ejector and packer in retracted positions in accordance with the present invention.
Figure 11:
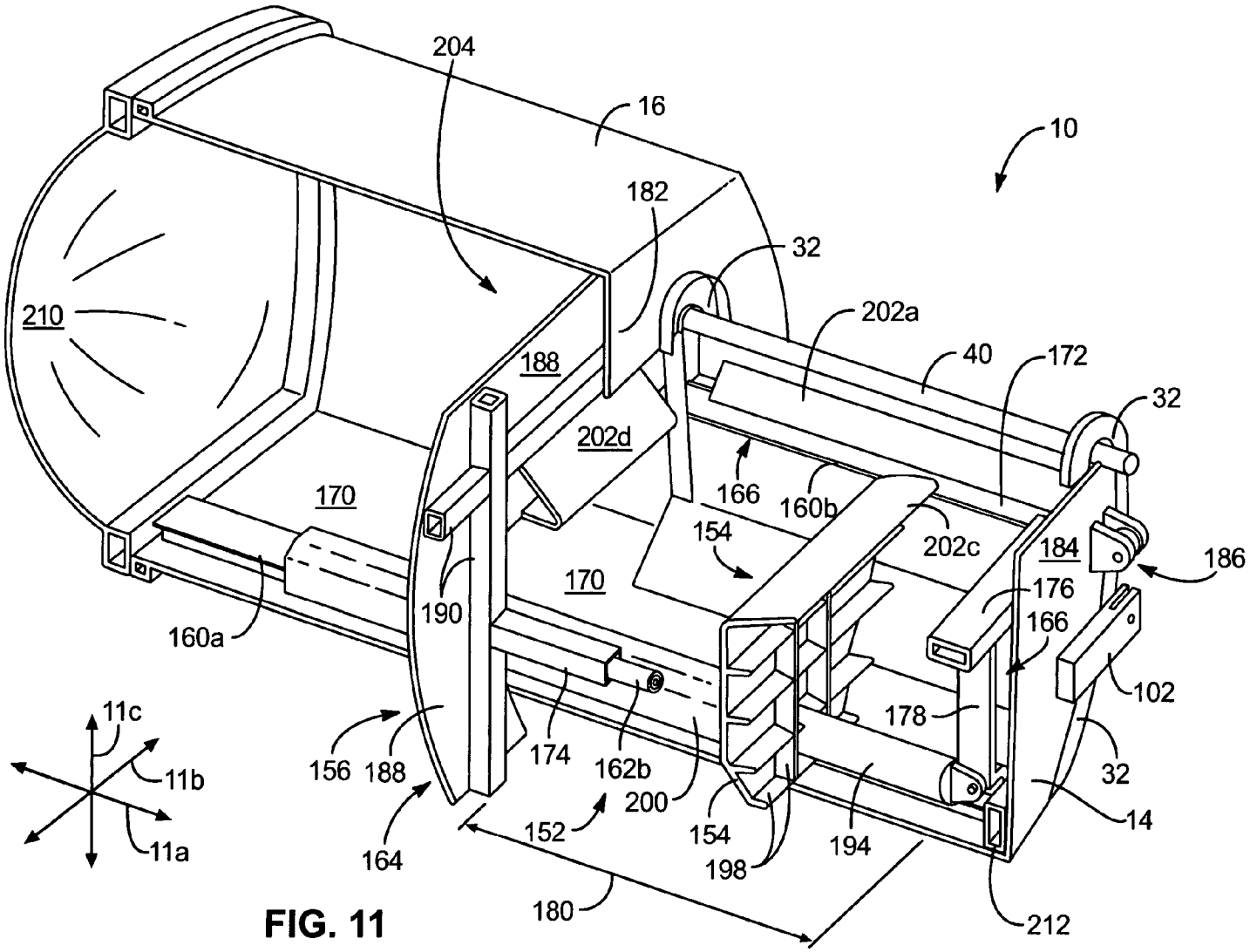
FIG. 11 is a partially cut-away, perspective view of a hopper and body where the ejector is in a retracted position and the packer is advancing from a retracted position toward an advanced position in accordance with the present invention.
Figure 12:
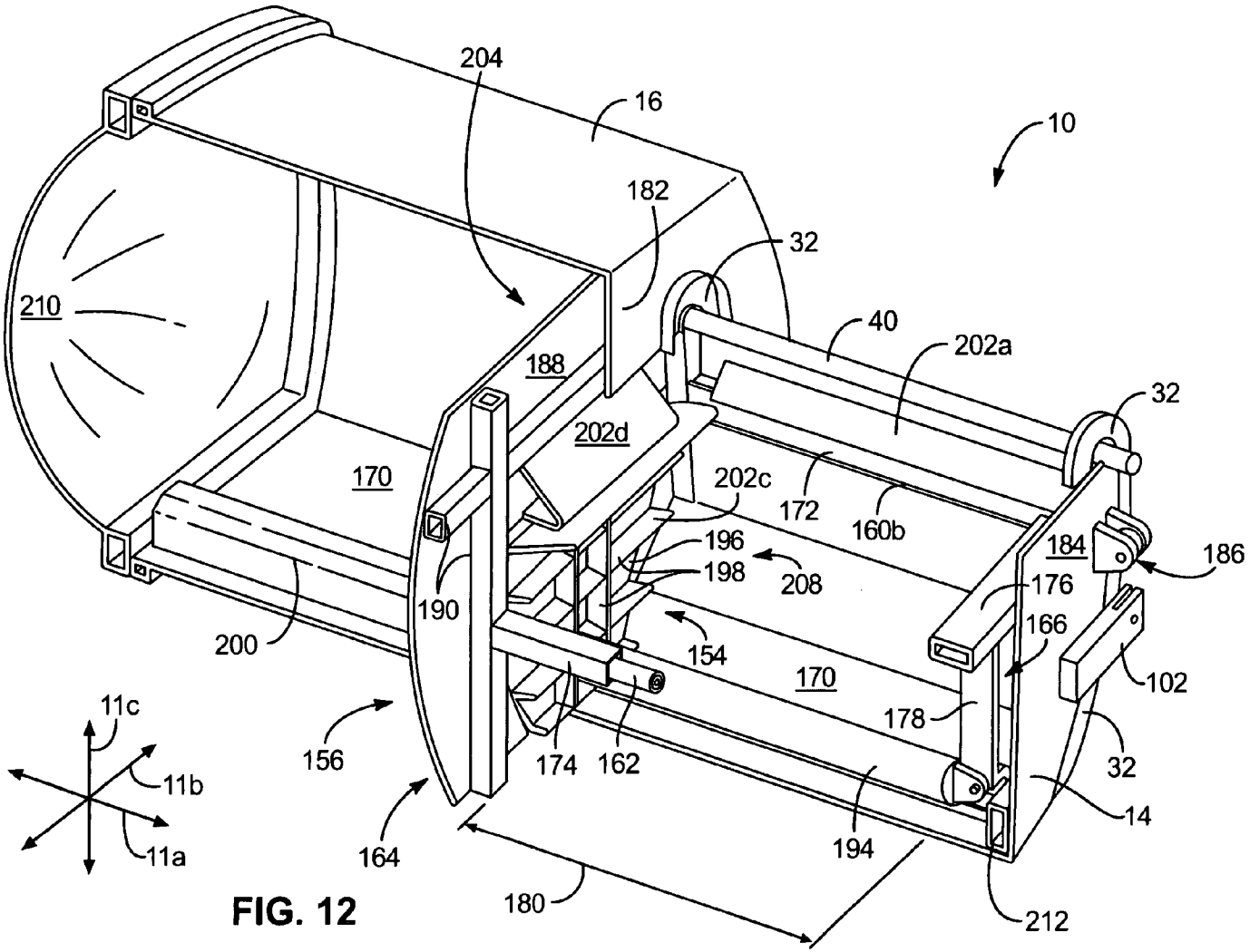
FIG. 12 is a partially cut-away, perspective view of a hopper and body where the ejector is in a retracted position and the packer is in an advanced position in accordance with the present invention.
Figure 13:
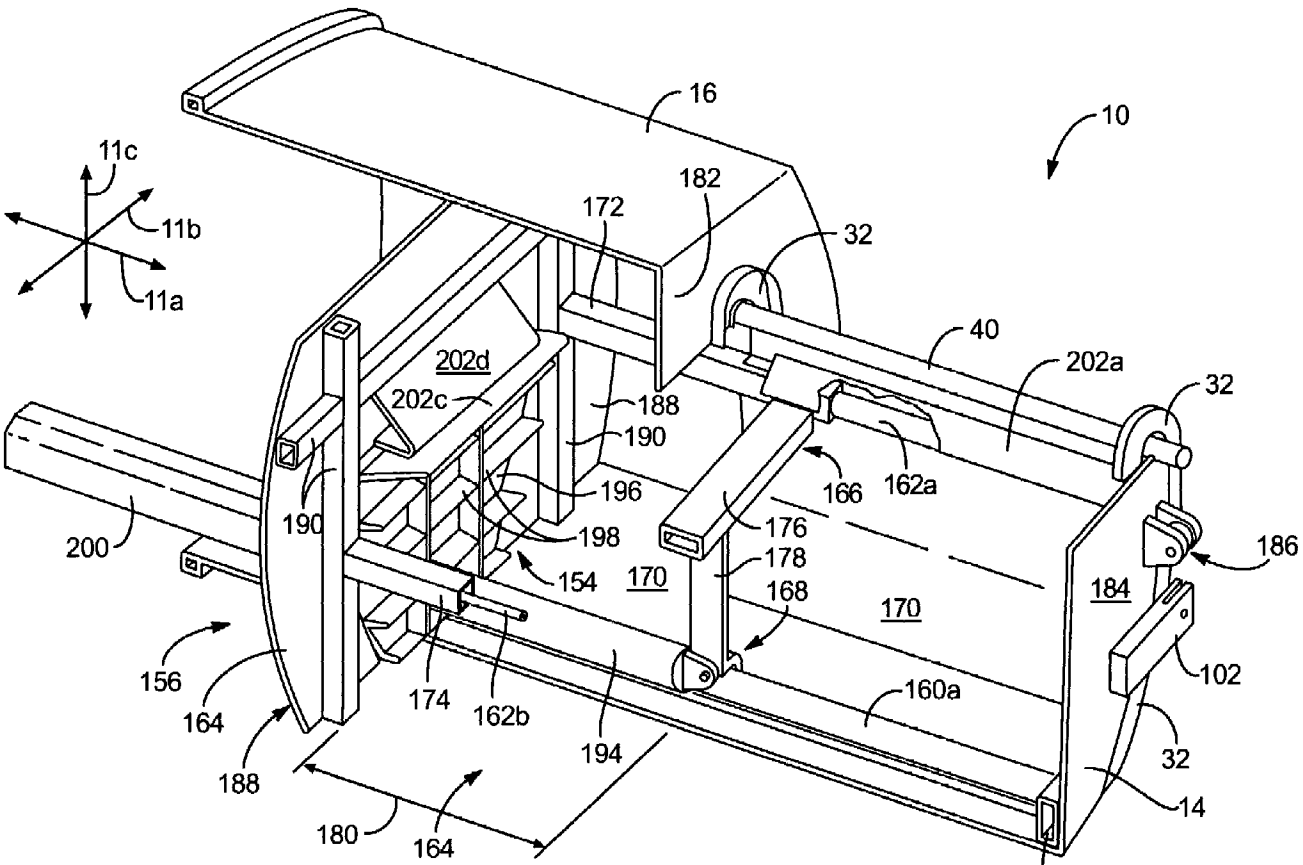
FIG. 13 is a partially cut-away, perspective view of a hopper and body where the ejector is advancing to eject refuse from the body and the packer is in an advanced position in accordance with the present invention.
Figure 14:
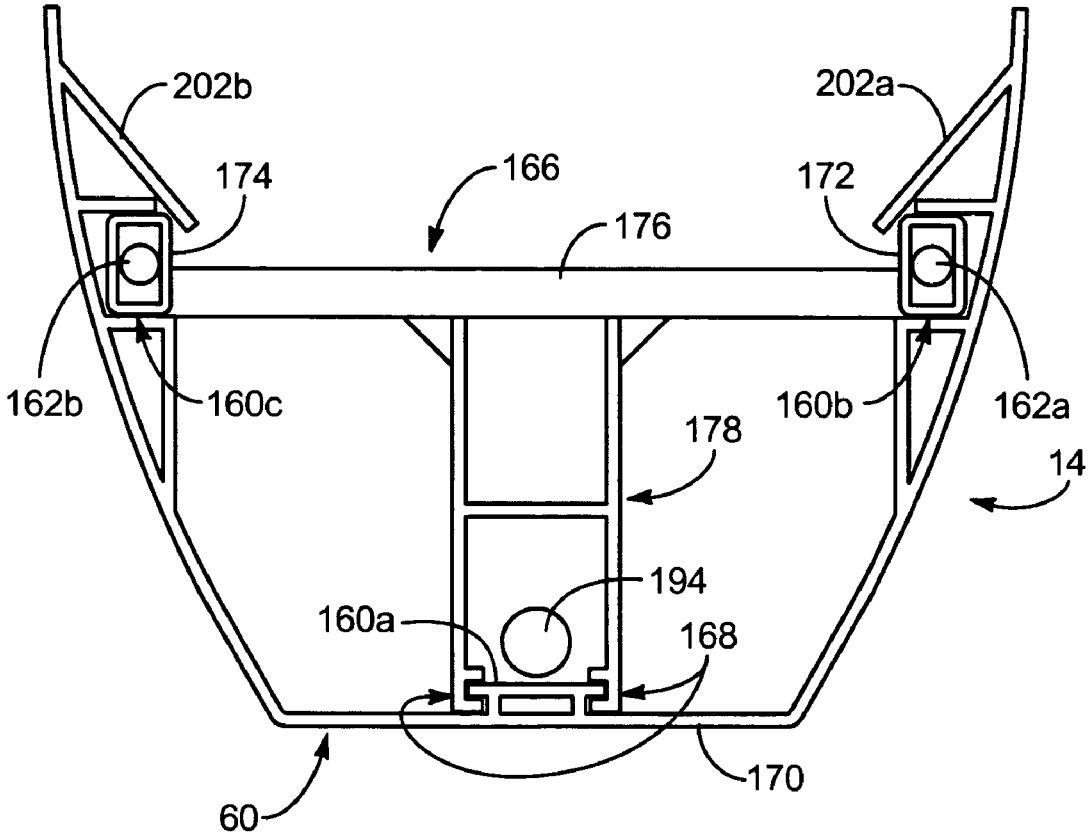
FIG. 14 is a front end elevation, cross-sectional view of a hopper and sled in accordance with the present invention.
Figure 14:
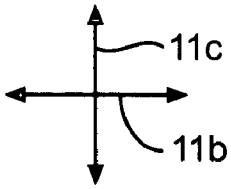

Referring to FIG. 9, any suitable mechanism may be used as a control mechanism 46 in accordance with the present invention. Factors that may be considered when selecting a control mechanism 46 may include cost, durability, reliability, speed of operation, power source, and the like. As described hereinabove, a control mechanism 46 may comprise a control linkage 48 acting under the direction of a hydraulic cylinder 50. In an alternative embodiment, a control mechanism 46 may comprise a drive train 144 and a motor 146.

A motor 146 in accordance with the present invention may be electric, hydraulic, pneumatic, or the like. Additionally, a motor 146 may be a power-take-off from the engine of the collection vehicle 10. In general, motors 146 operate most efficiently at rotational speeds that are too fast for a torsion tube 40 in accordance with the present invention. Accordingly, the drive train 144 may provide gearing as needed. For example, a drive train 144 may include multiple sprockets 148 connected by various chains 150. The sizing, positioning, and number of sprockets 148 may be selected to provide the desired rotational output and power. In an alternative embodiments, gears meshing directly with one another may be used.

In selected embodiments, the operating rotational velocity of a motor 146 in accordance with the present invention may be controlled to control the accelerations of the bins 22. In alternative embodiments, a motor 146 may operate at a constant speed and the lifting linkages 38 and track 32 may control the accelerations of the bins 22, as described hereinabove.

Referring to FIGS. 10-14, in selected embodiments in accordance with the present invention, a refuse collection vehicle 10 may include a system 152 for manipulating refuse within the hopper 14 and body 16. In certain embodiments, this system 152 may include a packer 154 and an ejector 156. The packer 154 may be primarily responsible for passing refuse deposited into the hopper 14 on to the body 16. The ejector 156 may be primarily responsible for discharging refuse from the body 16 at a landfill, processing plant, or the like.

In certain embodiments, an opening 158 positioned between the hopper 14 and body 16 may allow refuse to pass therebetween. One or more rails 160 may extend from the hopper 14, through the opening 158, and into the body 16. An ejector 156 in accordance with the present invention may slidingly engage at least one rail 160. One or more hydraulic cylinders 162 may extend between the ejector 156 and the vehicle 10 to provide relative motion therebetween. It is to be understood that while hydraulic cylinders (e.g. hydraulic cylinders 50, 162) are used in the illustrated embodiments, the present invention is not limited to such devices. Hydraulic cylinders may be replaced with any other motive devices that provides the desired range of motion and power. For example, in certain embodiments in accordance with the present invention, rack and pinion, cable and pulley, and like systems may be used.

In selected embodiments, an ejector 156 may comprise a platen 164 or ram 164 connected to a sled 166. The sled 166 may provide the structure for aligning and guiding the platen 164 with respect to the one or more rails 160. For example, in one embodiment, a sled 166 may include a first guide 168 slidingly engaging a rail 160*a* extending across the floor 170 of the hopper 14 and body 16. A second guide 172 may slidingly engage a rail 160*b* or recess 160*b* on one side of the hopper 14. A third guide 174 may slidingly engage a rail 160*c* or recess 160*c* on the other side of the hopper 14.

A sled 166 in accordance with the present invention may include a cross member 176 connecting the first guide 172 to the second guide 174. A post 178 may connect the cross member 176 to the first guide 168. If desired, the cross member 176 and post 178 may be spaced a selected distance 180 from the platen 164. For example, in one embodiment, the spacing 180 between the platen 164 and the cross member 176 and post 178 may permit the platen 164 to be positioned inside the body 16 proximate a forward wall 182 thereof while the cross member 176 and post 178 may be positioned inside the hopper 14 proximate a forward wall 184 thereof. In such an arrangement, the second and third guides 172, 174 may extend from the platen 164 to the cross member 176 to bridge the distance 180.

Second and third guides 172, 174 in accordance with the present invention may be formed as tubular members. In such an arrangement, a first hydraulic cylinder 162*a* may extend within the second guide 172 and a second hydraulic cylinder 162*b* may extend within the third guide 174. The forward wall 184 of the hopper 14 may include mounts 186 to facilitate securement of the first and second hydraulic cylinders 162 to the vehicle 10.

The platen 164 of an ejector 156 may comprise a plate 188 supported by reinforcing structures 190. In selected embodiments, the perimeter of the plate 188 may correspond to the interior shape of the body 16. A platen 164 in accordance with the present invention need not be planar nor continuous. For example, a platen 164 may have an aperture 192 formed therein corresponding to the opening 158 between the hopper 14 and the body 16. Accordingly, the aperture 192 may permit refuse to pass from one side of the platen 164 to the other.

A packer 154 in accordance with the present invention may be formed as a platen slidingly engaging a rail 160. In one embodiment, the packer 154 may slidingly engage the rail 160*a* extending along the floor 170 of the hopper 14 and body 16. A hydraulic cylinder 194, or other motive device, may extend between the packer 154 and the sled 166. Accordingly, while the ejector 156 may be moved with respect to the vehicle 10, the packer 154 may be moved with respect to the ejector 156.

Similar to the ejector 156, a packer 154 may comprise a plate 196 supported by reinforcing structure 198. The plate 196 may have a perimeter corresponding to the perimeter of the hopper 14. Additionally, the perimeter of the plate 196 may substantially correspond to that of the aperture 192 in the ejector 156.

A packer 154 may include a housing 200 extending therefrom. The housing 200 may protect the hydraulic cylinder 194 from falling refuse. In one embodiment, the hydraulic cylinder 194 extends from the packer 154 to the post 178 of the sled 166 along the rail 160*a*. In such an arrangement, the housing 200 may form a "doghouse" over the hydraulic cylinder 194 and rail 160*a*.

Refuse deflectors 202 may be incorporated as needed or desired. Such deflectors 202 may direct refuse falling from a dumping bin 22 toward the center of the hopper 14 and away from selected moving parts, overlaps, or interfaces. For example, side deflectors 202*a*, 202*b* may be positioned on the interior sides of the hopper 15 to limit the access of falling refuse to the interface between the second and third guides 172, 174 and the corresponding rails 160*b*, 160*c*. A deflector 202*c* may be incorporated as part of the packer 154. Additionally, a deflector 202*d* may be positioned on the ejector 156.

In operation, the ejector 156 may be maintained in a retracted position 204. In the retracted position 204, the platen 164 of the ejector 156 may be positioned inside the body 16 proximate the forward wall 182 thereof, while the cross member 176 and post 178 of the sled 166 may be positioned inside the hopper 14 proximate the forward wall 184 thereof. With the sled 166 so positioned, the hydraulic cylinder 194 connecting the packer 154 to the sled 166 may move the packer 154 back and forth longitudinally 11*a* within the hopper 14. To receive refuse, the packer 154 may be withdrawn to a retracted position 206. As the hopper 14 fills, the packer 154 may be advance to push the refuse through the opening 158 between the hopper 14 and body 16, through the aperture 192 in the ejector 156, and into the body 16. To receive additional refuse, the packer may be returned to the retracted position 206.

As the body 16 fills with refuse, the packer 154 may pack or compress all of the refuse within the body 16. In selected embodiments, this compression of the refuse within the body 16 may be accomplished even when the packer 154 does not enter the body 16. That is, as the packer 154 continues to force more refuse into the body 16, the refuse adjusts and compresses to accommodate the incoming refuse.

Once the body 16 is filled to a desired capacity and compaction, the packer 154 may be left in the advanced position 208. Accordingly, as the tailgate 210 of the vehicle 10 is opened and the ejector 156 advanced, the packer 154 moves with the sled 166 and effectively fills the aperture 192 in the ejector 156 so that all the refuse may be expelled from the body 16. Once the refuse is expelled from the body 16, the ejector 156 and the packer 156 may be returned to the their respective retracted positions 204, 206. If desired, a register 212 or stop 212 may stop the retraction of the sled 166 at a desired location.

Figure 15:
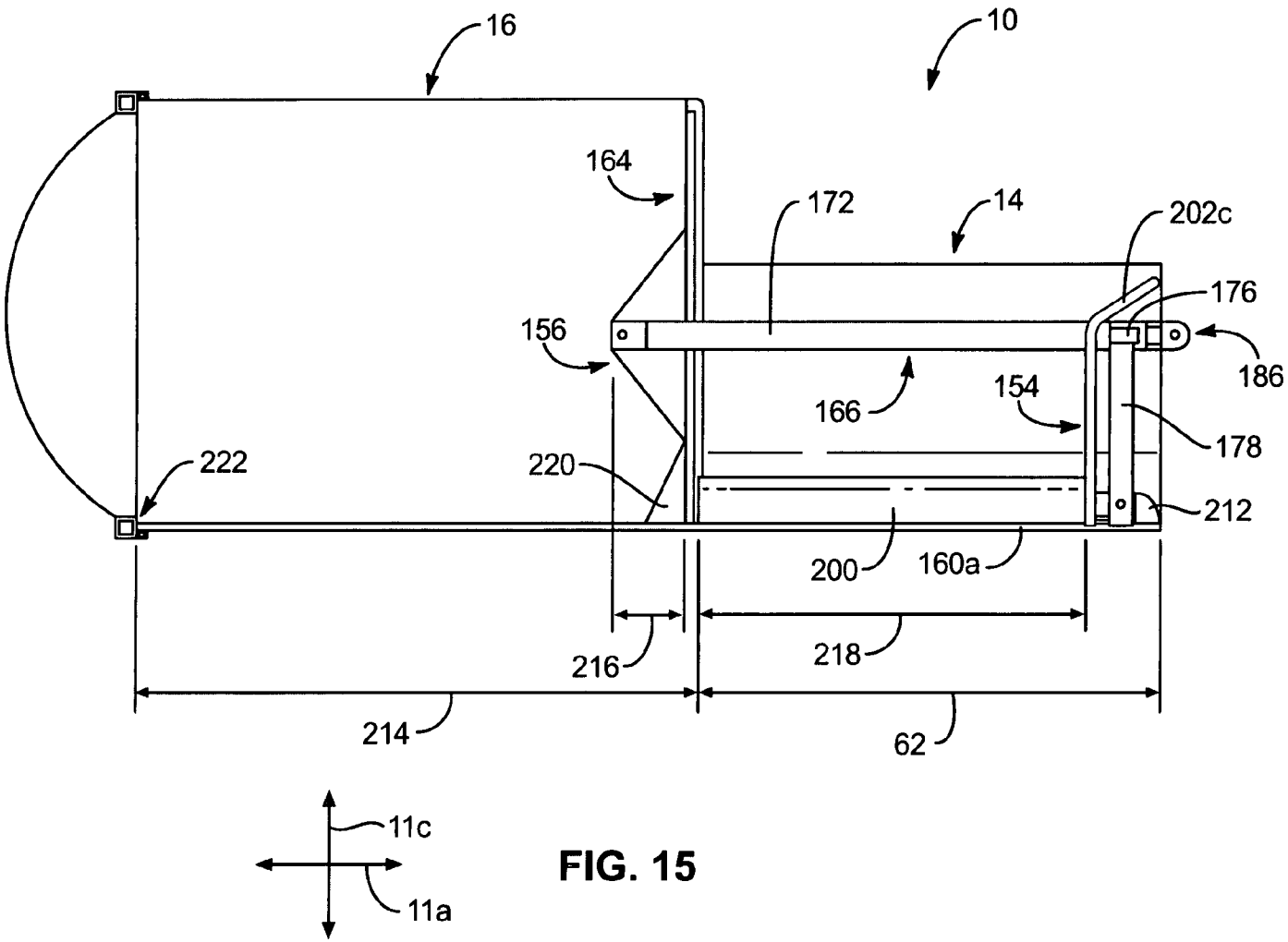
FIG. 15 is a right side elevation, cross-sectional view of a hopper and body with corresponding packer and ejector in accordance with the present invention.

Referring to FIG. 15, in selected embodiments, the length 56, 62 of a hopper 14 may be less than the length 214 of a body 16. In such embodiments, the second and third guides 172, 174 and the corresponding hydraulic cylinders 162 positioned therewithin may extend a selected distance 216 into the body 16. In such an arrangement, the throw or stroke of the hydraulic cylinders 162 may be increased to a point where single-stage, double-acting, hydraulic cylinders 162 may be used to accomplish the entire ejection stroke. Similarly, the length 218 of the housing 200 and the hydraulic cylinder 194 contained therein may be selected so a single-stage, double-acting, hydraulic cylinder 194 may accomplish the entire packing stroke.

In selected embodiments, the platen 164 of an ejector 156 may have a plow 220 formed thereon. The plow 220 may be positioned along the lower edge of the platen 164 to assist in expelling refuse from the body 16. In one embodiment, the plow 220 is angled to direct refuse out over the trailing edge 222 of the body 16 even when the rest of the platen 164 stops advancing some distance before the trailing edge 222.

Figure 16:
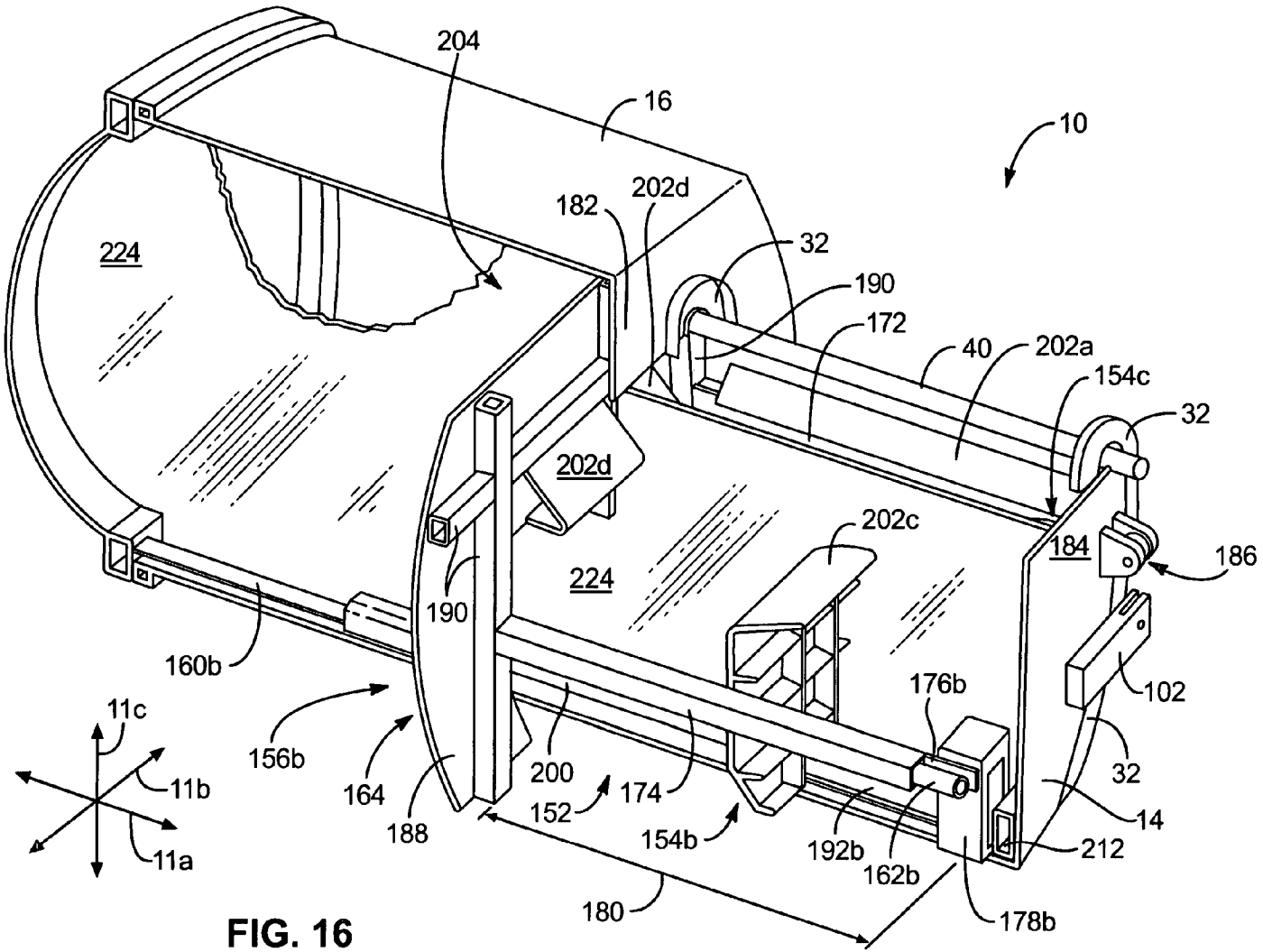
FIG. 16 is a partially cut-away, perspective view of a divided hopper and body having an independently operating ejector and packer in accordance with the present invention on both sides of the dividing wall.
Figure 17:
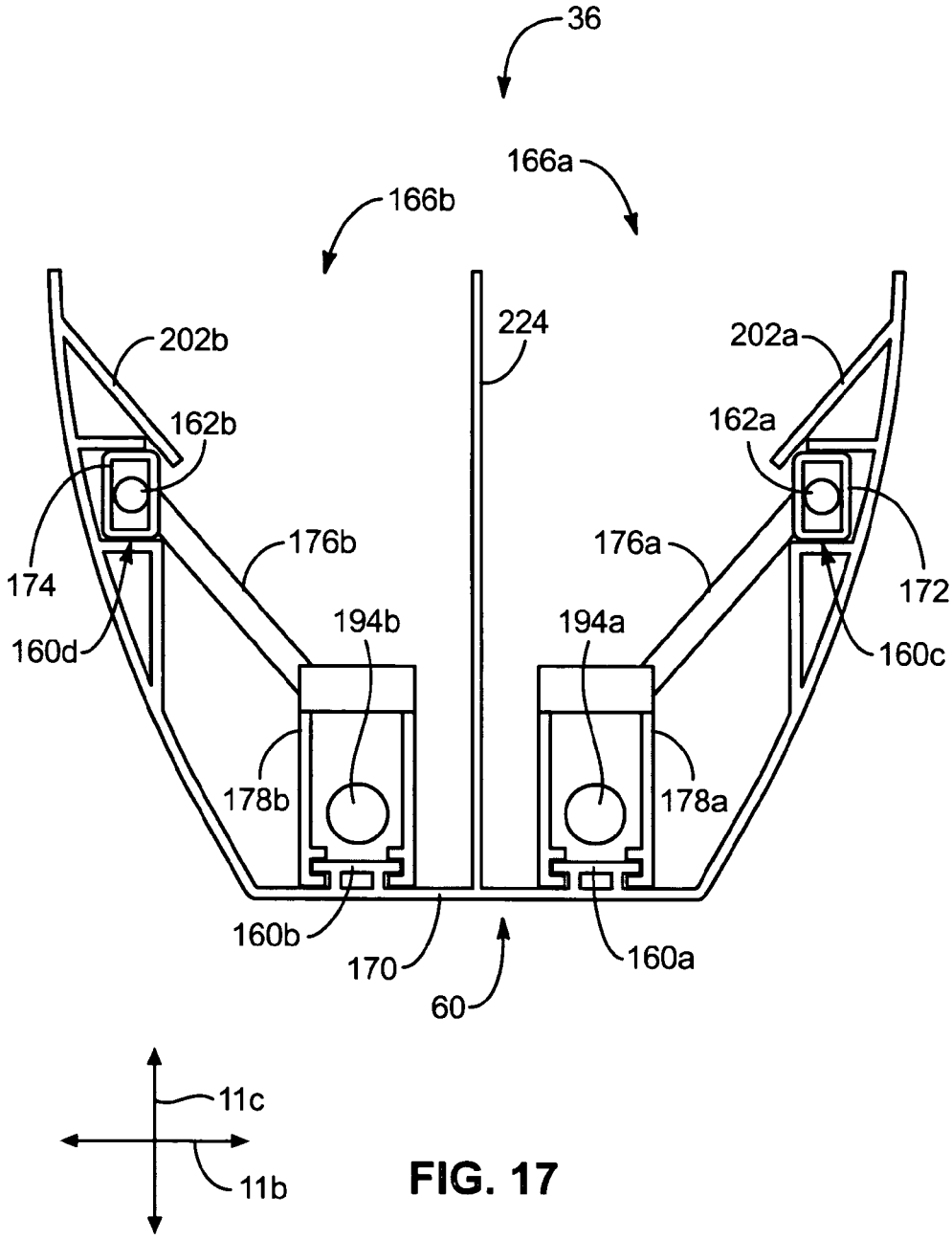
FIG. 17 is a front end elevation, cross-sectional view of a divided hopper and independent sleds in accordance with the present invention.

Referring to FIGS. 16 and 17, a vehicle 10 in accordance with the present invention may be arranged to receive different types of refuse simultaneously. For example, a hopper 14 and body 16 may be divided to receive recyclable refuse in one area and non-recyclable refuse in another. A hopper 14 and body 16 may be divided in a variety of ways. A hopper 14 and body 16 may be divided horizontally. Alternatively, in selected embodiments, a vertical wall 224 may divide a hopper 14 and body 16. In either arrangement, a packer 154 and ejector 156 may operate independently on each side of the divide (e.g. wall 224).

In certain vertically divided embodiments, two rails 160 may extend along the floor 170 of the hopper 14 and body 16, one on each side of the dividing vertical wall 224. A first post 178*a* of a first sled 166*a* may slidingly engage one rail 160*a*. A second post 178*b* of a second sled 166*b* may slidingly engaging the other rail 160*b*. Each sled 166*a*, 166*b* may include at least one guide 172, 174 slidingly engaging a corresponding rail 160*b*, 160*c* or recess 160*b*, 160*c*. A first cross member 176*a* may connect the first post 178*a* to the first guide 172. A second cross member 176*b* may connect the second post 178*b* to the second guide 174.

In operation, a hydraulic cylinder 162*a* positioned within a first guide 172 may manipulate one ejector 156*a*, while a hydraulic cylinder 162*b* within a second guide 174 may manipulate the other ejector 156*b*. Similarly, a packer 154*a* operating on one side of the dividing wall 224 may be manipulated by one hydraulic cylinder 194*a*, while a packer 154*b* operating on the other side of the dividing wall 224 may be manipulated by another hydraulic cylinder 194*b*.

Figure 18:
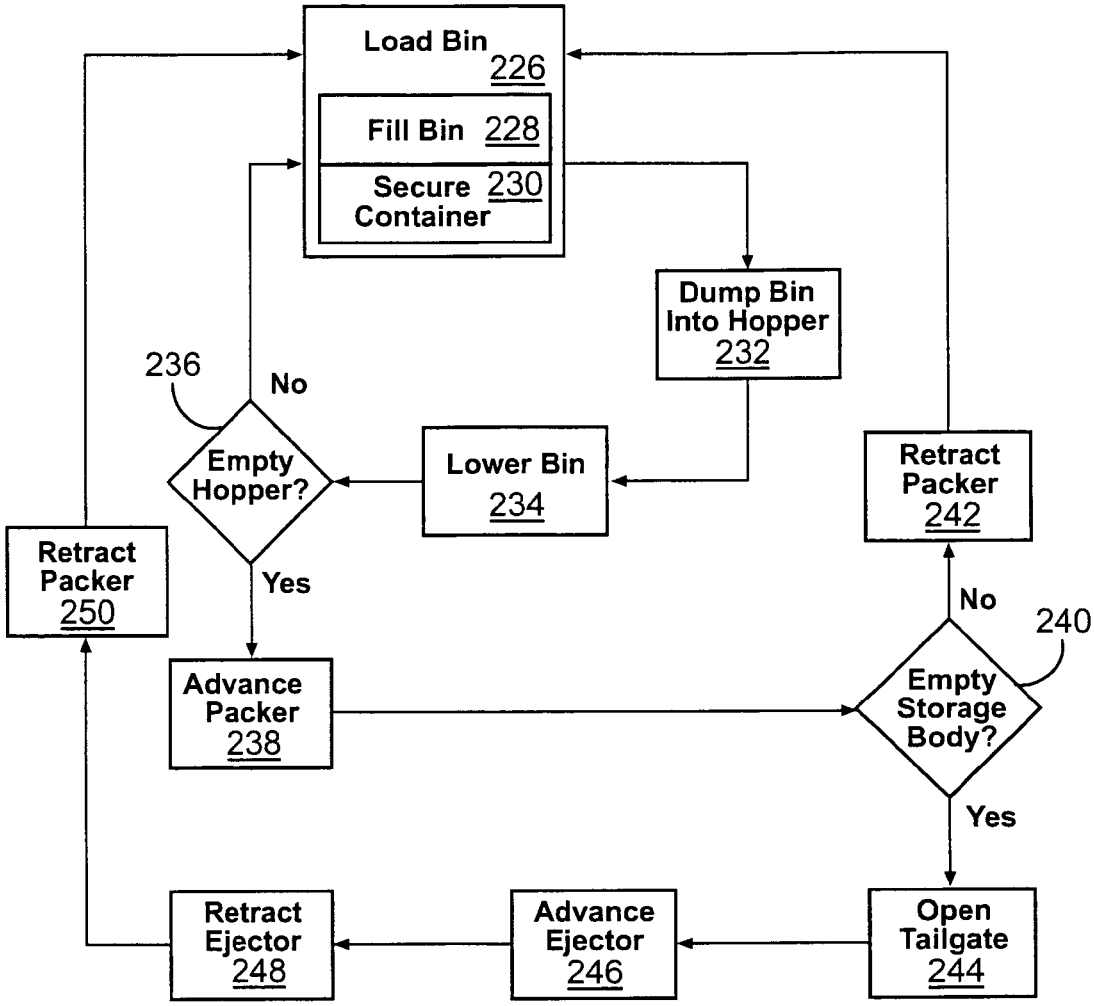
FIG. 18 is a schematic block diagram illustrating the operation of one embodiment of a refuse collection vehicle in accordance with the present invention.

Referring to FIG. 18, to begin operation, a bin 22 may be in the stowed position 30, a packer 154 may be in a retracted position 206, and an ejector 156 may be in a retracted position 204. When in a stowed position 30 a bin 22 may be loaded 226 in at least two ways. First, refuse may be placed 228 directed into the bin 22. Second, a container (e.g. a standardized container 128) may be secured 230 to the bin 22. One or both of the loading methods 228, 230 may be used at any particular refuse collection location. Once loaded 226, a bin 22 may be lifted and dumped 232 into the hopper 14. In selected embodiments, the bin 22 may be lifted and dumped 232 upon activation of an appropriate switch or control by an operator. After sufficient dumping time, a bin 22 may be lowered 234 back to the stowed position 30.

With refuse in the hopper 14, a decision 236 may be made whether to empty the hopper 14. In selected embodiments, this decision 236 may be made by an operator based on a visual inspection of the remaining capacity within the hopper 14. If desired, visual inspection may be facilitated through the use of appropriately positioned mirrors. In other embodiments, automated sensors may determine whether and when to empty a hopper 14.

If the hopper 14 is not to be emptied, more refuse may be loaded 226 into the bin 22. On the other hand, if the hopper 14 is to be emptied, an operator or automated sensor may initiate advancement 238 of the packer 154. As the packer 154 advances 238, refuse may be pushed from the hopper 14, through the opening 158 between the hopper 14 and body 16, through the aperture 192 in the ejector 156, and into the body 16 for storage.

With refuse in the body 16, a decision 240 may be made whether to empty the body 16. In selected embodiments, to assist in making this decision 240, one or more sensors may determine when a body 16 has been filled to capacity. For example, in certain embodiments, a measure of the force necessary to advance 238 a packer 154 may be an indicator of the remaining capacity of the body 16. As the body 16 nears capacity, the force required by the packer 154 to introduce additional refuse may greatly increase.

If it is determined that the body 16 is not to be emptied, the packer 154 may retract 242 and the vehicle 10 may proceed to the next collection site. On the other hand, upon determining that the body 16 is to be emptied, an operator may proceed to an appropriate unloading site. The tailgate 210 may be opened 244 and the ejector 156 may be advanced 246. After all the refuse has been expelled from the body 16, the ejector 156 and the packer 154 may be retracted 248, 250. With the bins 22 in the stowed position 30 and the packer 154 and ejector 156 in respective retracted positions 206, 204, the vehicle 10 may be ready to receive more refuse.

The present invention may be embodied in other specific forms without departing from its basic functions, structures, or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An apparatus comprising:

a vehicle comprising a frame formed as two substantially parallel members extending lengthwise and a hopper secured to the frame;

first and second bins sized to receive refuse therein;

first and second dumping mechanisms respectively connecting the first and second bins to opposite, exterior sides of the hopper and selectively, independently, and respectively moving the first and second bins between stowed positions at least partially directly underneath the hopper and dumping positions above the hopper; and the first dumping mechanism comprising a torsion member selected from the group consisting of a torsion bar and a torsion tube, a first linkage connecting a first side of the first bin to the torsion member, a second linkage connecting a second side of the first bin to the torsion member for synchronously lifting the first and second sides of the first bin, and a single four-bar linkage applying to the torsion member substantially exclusively a torsional load to move synchronously the first and second sides of the first bin between the stowed and dumping positions.

2. The apparatus of claim 1, wherein the maximum width of the vehicle and first and second bins, when the first and second bins are both in the stowed position, is less than or equal to one hundred two inches.

3. The apparatus of claim 2, wherein the first bin comprises a first engagement mechanism positioned on an exterior thereof to engage and secure a standardized refuse container.

4. The apparatus of claim 3, wherein the second bin comprises a second engagement mechanism positioned to extend beyond an exterior surface thereof to engage and secure a standardized refuse container.

5. The apparatus of claim 4, wherein the first bin has at least one roller positioned at each of a forward end and a rearward end thereof.

6. The apparatus of claim 5, wherein the first dumping mechanism comprises:

a first track secured to the hopper to guide the at least one roller positioned at the forward end of the first bin; and a second track secured to the hopper to guide the at least one roller positioned at the rearward end of the first bin.

7. The apparatus of claim 6, wherein the second dumping mechanism comprises:

a torsion tube;

a first linkage connecting the forward end of the first bin to the torsion tube; and a second linkage connecting the rearward end of the first bin to the torsion tube.

8. The apparatus of claim 7, wherein the second dumping mechanism further comprises a control mechanism applying to the torsion tube substantially exclusively a torsional load to move the second bin between the stowed and dumping positions.

9. The apparatus of claim 8, wherein the vehicle further comprises a body secured to the frame, the body having a first opening operably communicating from the hopper to the body, and at least one rail extending from the hopper, through the first opening, to the body.

10. The apparatus of claim 9, further comprising an ejector comprising a first platen positioned within the body, a sled secured to the first platen and slidingly engaging the rail, and a first hydraulic cylinder connecting the sled to the vehicle to selectively advance and retract the sled with respect thereto.

11. The apparatus of claim 10, further comprising a packer comprising a second platen slidingly engaging the rail and a second hydraulic cylinder connecting the second platen to the sled to advance and retract the second platen with respect thereto.

12. The apparatus of claim 11, wherein the packer is positioned to advance and retract substantially exclusively within the hopper when the ejector is in a retracted position.

13. The apparatus of claim 12, wherein the first platen has a second opening corresponding to the first opening.

14. The apparatus of claim 13, wherein the second platen has a perimeter corresponding to a perimeter of the hopper.

15. The apparatus of claim 14, wherein the first platen has a perimeter corresponding to a perimeter of the body.

16. The apparatus of claim 15, further comprising a third hydraulic cylinder connecting the sled to the vehicle, the third hydraulic cylinder working in conjunction with the first hydraulic cylinder to advance and retract the sled with respect thereto.

17. The apparatus of claim 16, wherein the control linkage of the first dumping mechanism comprises a fourth hydraulic cylinder.

18. The apparatus of claim 17, wherein the first dumping mechanism comprises a single hydraulic cylinder only.

19. The apparatus of claim 18, wherein the first, second, third, and fourth hydraulic cylinders are each single-stage, double-acting hydraulic cylinders.

20. The apparatus of claim 1, wherein the vehicle further comprises a body provided with an opening connecting the hopper to the body, and at least one rail extending from the hopper, through the opening, to the body.

21. The apparatus of claim 20, further comprising:

an ejector comprising a first platen positioned within the body, a sled secured to the first platen and slidingly engaging the rail, and a first hydraulic cylinder connecting the sled to the vehicle to advance and retract the sled with respect thereto; and a packer comprising a second platen slidingly engaging the rail and a second hydraulic cylinder connecting the second platen to the sled to advance and retract the second platen with respect thereto.

22. The apparatus of claim 21, wherein the packer is positioned to advance and retract substantially exclusively within the hopper when the ejector is in a retracted position.

23. An apparatus defining longitudinal, lateral, and transverse directions substantially orthogonal to one another, the apparatus comprising:

a vehicle comprising a frame formed as two substantially parallel members extending in the longitudinal direction, a body secured to the frame, and a hopper secured to the frame to receive refuse and transfer the refuse into the body;

first and second bins;

first and second dumping mechanisms respectively connecting the first and second bins to opposite, exterior sides of the frame, each of the first and second bins being located at least partially directly underneath the hopper, and selectively and respectively moving the first and second bins between stowed positions substantially below the hopper and dumping positions above the hopper;

the bins and vehicle sized together, wherein the width in the lateral direction between the exterior extremes of the first and second bins when both are in stowed positions is substantially defined by a summation of the width of the first bin in the lateral direction, the distance between the outer extremes of the frame in the lateral direction, and the width of the second bin in the lateral direction; and the first dumping mechanism comprising a torsion member selected from the group consisting of a torsion bar and a torsion tube, a first linkage connecting the forward end of the first bin to the torsion member to be lifted directly thereby, a second linkage connecting the rearward end of the first bin to the torsion member to be lifted directly thereby, and a single four-bar linkage applying to the torsion member substantially exclusively a torsional load to move the first bin between the stowed and dumping positions.

24. The apparatus of claim 23, wherein the width in the lateral direction between the exterior extremes of the first and second bins when both are in stowed positioned is less than or equal to one hundred two inches.

25. The apparatus of claim 24, wherein the distance between the outer extremes of the frame in the lateral direction is less than or equal to thirty-four inches.

26. An apparatus comprising:

a vehicle comprising a frame formed as two substantially parallel members extending lengthwise, a hopper secured to the frame, a body distinct from the hopper and secured to the frame, a first opening connecting the hopper to the body, and at least one rail extending from the hopper, through the first opening, and into the body;

at least one bin sized to receive refuse therein;

at least one dumping mechanism connecting the at least one bin to a side of the hopper and selectively moving the at least one bin between a stowed position at least partially directly underneath the hopper and a dumping position above the hopper, the at least one dumping mechanism comprising a torsion member, a first linkage connecting a first side of the at least one bin to the torsion member, a second linkage connecting a second side of the at least one bin to the torsion member for synchronously lifting the first and second sides of the at least one bin, and a single four-bar linkage applying to the torsion member substantially exclusively a torsional load to move synchronously the first and second sides of the at least one bin between the stowed and dumping positions;

an ejector positioned within the body and slidingly engaging the rail;

a first hydraulic cylinder connecting the ejector to the vehicle to advance and retract the ejector with respect thereto;

a packer slidingly engaging the rail to pack refuse from the hopper, through the first opening, and into the body; and a second hydraulic cylinder connecting the packer to the ejector to advance and retract the packer with respect thereto during packing and to selectively align the packer with the ejector to function with the ejector to eject the refuse from the body.

* * * * *